US005211690A

United States Patent [19]

Mizoguchi et al.

[11] Patent Number: 5,211,690

[45] Date of Patent: May 18, 1993

[54] TRANSMISSION CLUTCH AND RECORDING APPARATUS WHICH USES THE TRANSMISSION CLUTCH

[75] Inventors: Yoshiyuki Mizoguchi; Yoshitaka Watanabe, both of Kawasaki, Japan

[73] Assignee: Canon Kabushiki Kaisha, Tokyo, Japan

[21] Appl. No.: 860,246

[22] Filed: Mar. 27, 1992

Related U.S. Application Data

[63] Continuation of Ser. No. 454,897, Dec. 22, 1989, abandoned.

[30] Foreign Application Priority Data

Dec. 23, 1988 [JP] Japan ..... 63-323565

[51] Int. Cl.[5] ..... B65H 3/04

[52] U.S. Cl. ..... 271/10; 271/34; 271/902; 400/629; 400/636.2

[58] Field of Search ..... 271/116, 902, 10, 34; 400/624, 625, 636.2, 608.3, 629

[56] References Cited

U.S. PATENT DOCUMENTS

| | | | |
|---|---|---|---|
| 4,529,188 | 7/1985 | Sturnick | 271/114 X |
| 4,544,294 | 10/1985 | Runzi | 400/636.2 |
| 4,581,618 | 4/1986 | Watanabe et al. . | |
| 4,638,987 | 1/1987 | Sakurai | 271/902 X |
| 4,691,911 | 9/1987 | Nakagawa | 400/636.2 |
| 4,721,297 | 1/1988 | Katayama | 400/636.2 |
| 4,798,374 | 1/1989 | Ito | 400/636.2 X |
| 4,884,909 | 12/1989 | Watanabe et al. . | |

*Primary Examiner*—Richard A. Schacher

*Attorney, Agent, or Firm*—Fitzpatrick, Cella, Harper & Scinto

[57] ABSTRACT

A recording and reproducing apparatus includes a sheet supply mechanism, a sheet transporting mechanism, an image recording mechanism and a sheet discharging mechanism. The mechanisms are driven by a rotary driver which transmits a driving force through a driving force transmitter to a plurality of rotating bodies. The driving force transmitter can engage a selected number of mechanisms through the rotating bodies to transmit the driving force from the rotary driver.

11 Claims, 22 Drawing Sheets

TRANSMISSION CLUTCH AND RECORDING APPARATUS WHICH USES THE TRANSMISSION CLUTCH

This application is a continuation of application Ser. No. 07/454,897, filed Dec. 22, 1989, now abandoned.

BACKGROUND OF THE INVENTION

1. Field of the Invention

This invention relates to a transmission clutch apparatus which transmits a driving force to a plurality of driving systems within a recording apparatus, and also relates to a recording apparatus which uses the driving force transmission clutch.

2. Description of the Prior Art

Video devices and the like are widely used today, and along with their popularity and development, an apparatus for recording their video images has also been developed. Although there exists various methods for recording images, a so-called thermal recording method is generally utilized. In a thermal recording method, images are recorded by heating recording heads according to image signals. Such a method is advantageous because it reduces the size and cost of the apparatus. When color images are recorded by the thermal recording method, a leading edge of a recording sheet is held by a gripper against a rotary platen which rotates for every color. As the rotary platen is rotated, the recording heads are heated and color images are recorded on the recording sheet. However, in the above recording apparatus, supplying the recording sheet, transporting it to the platen, rolling an ink sheet and so forth have to be carried out either simultaneously or individually. Therefore, electric motors are needed for driving each mechanism which increases the number of parts and makes it difficult to reduce the size of the apparatus.

As an alternative, U.S. Pat. No. 4,268,021 discloses a sheet supply device which drives a platen, a pick-up roller, a transporting roller and a discharging roller with a single step motor. However, in this prior art device an electro-magnetic clutch is used to rotate the pick-up roller and transporting roller independently from the platen, which results in an increased number of parts.

SUMMARY OF THE INVENTION

An object of the present invention is to solve the above-described drawbacks and provide a method for driving a clutch which transmits a driving force, and a recording apparatus that uses the clutch such that a driving force from an electric motor can be selectively transmitted to drive each drive system.

Toward that end, one aspect of Applicants' invention relates to a recording and reproducing apparatus comprising sheet supply means for supplying a sheet of paper from a stack of sheets, transporting means for transporting a sheet supplied by the sheet supply means within the recording and reproducing apparatus, and recording means for recording an image on the paper while it is being transported by the transporting means, with the recording means including ink transferring means for transferring ink to the paper. Sheet discharging means discharge a sheet of paper transported by the transporting means, while a first rotating body drives the sheet supply means and the sheet discharging means, a second rotating body drives the transporting means, and a third rotating body drives the ink transferring means. Rotary drive means drives the first, second and third rotary bodies, and driving force transmitting means, engageable with the first, second and third rotary bodies and the rotary driven means, transmits a driving force therebetween. The rotary drive means rotates in a forward direction and the driving force transmitting means rotates about its own axis in a first mode to transmit a driving force to selected rotary bodies. Also, the rotary drive means rotates in a reverse direction and the drive force transmitting means revolves about the rotary drive means in a second mode to align itself with selected rotary bodies.

In another aspect of Applicants' invention, a driving force transmitting apparatus comprises a rotary drive means, having a rotary drive axis, rotating in a forward direction and a reverse direction, and a plurality of rotary driven bodies disposed proximate to the rotary drive means. Driving force transmitting means is engageable with the rotary driven bodies and the rotary drive means for transmitting a force therebetween. The driving force transmitting means rotates about its own axis in a first mode and revolves around the rotary drive axis in a second mode. The driving force transmitting means transmits a driving force to the rotary driven bodies when the rotary drive means rotates in a forward direction. The driving force transmitting means is displaced in a first position to transmit a driving force to the rotary driven bodies, or displaced in a second position so as to not transmit a driving force to the rotary bodies when the rotary drive means rotates in the reverse direction. Lastly, control means differentiates the rotary speed of the rotary drive means between the forward direction and the reverse direction.

BRIEF DESCRIPTION OF THE DRAWINGS

The structure, functions, and advantages of the present invention will become apparent from the following detailed description of the preferred embodiment and the appended drawings, in which.

DETAILED DESCRIPTION OF THE PREFERRED EMBODIMENT

Figure 1:
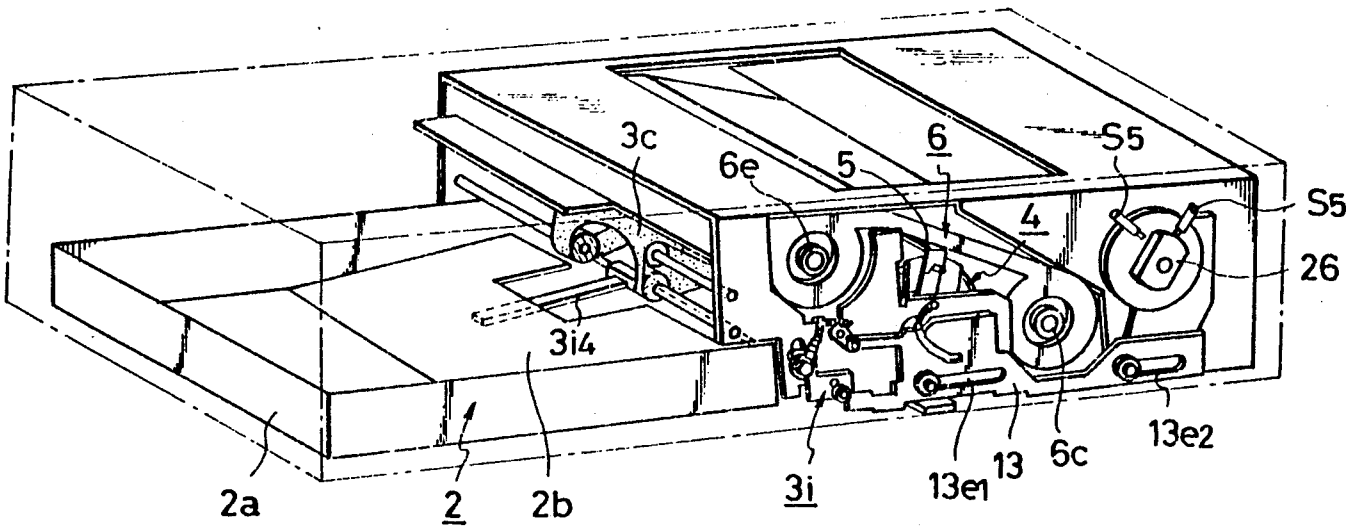
FIG. 1 is a perspective outer view of a recording apparatus according to one embodiment of the present invention.

One embodiment of the present invention will be explained with reference to the Figures.

The following is an outline of the entire apparatus. With reference to FIG. 2B, a plurality of cut sheets 1 for recording are stacked and placed within a cassette 2 and the recording sheets are separated and sent forth one by one by a paper supply means 3. A leading edge of the sheet is seized by a gripper 5, which is attached to a transport means—a platen 4, and transported in the direction of arrow a along with rotation of the platen 4.

During recording, an ink sheet 7 within an ink cassette 6 is transported in the direction of arrow b and is synchronized with the rotation of the platen 4. Recording heads 8 move up and down to press the ink sheet against the recording sheet 1. At the same time, the recording heads 8 are heated according to image signals and the ink on the ink sheet is transferred to record an image on the recording sheet 1. After the recording is completed, the recording sheet 1 is discharged by a discharge means 9 to an outlet 10.

A rotary cam 12 is rotated by a DC motor 11 and regulates movement of the recording heads 8. A first straight motion cam 13 (FIG. 2(B)) and a second straight motion cam 14 (FIG. 2(A)) slide the paper supply means 3 to operate the gripper 5, the recording heads 8 and the discharge means 9. For supplying and discharging the recording sheet 1 by the supply means 3 and the discharge means 9, rotating the platen 4 and winding the ink sheet, a driving force is transmitted from a stepping motor (hereinafter "St motor") through a clutch 16.

Next, the structure of the above-mentioned portions will be explained in detail.

The structure of the cassette 2 is shown in FIG. 1 and FIGS. 2(A) and 2(B). A cassette case 2*a* for storing recording sheets 1 is detachably placed into the recording apparatus body. A sheet-rest 2*b* is placed on the base of the case 2*a* to store and hold the stacked recording sheets.

Figure 4:
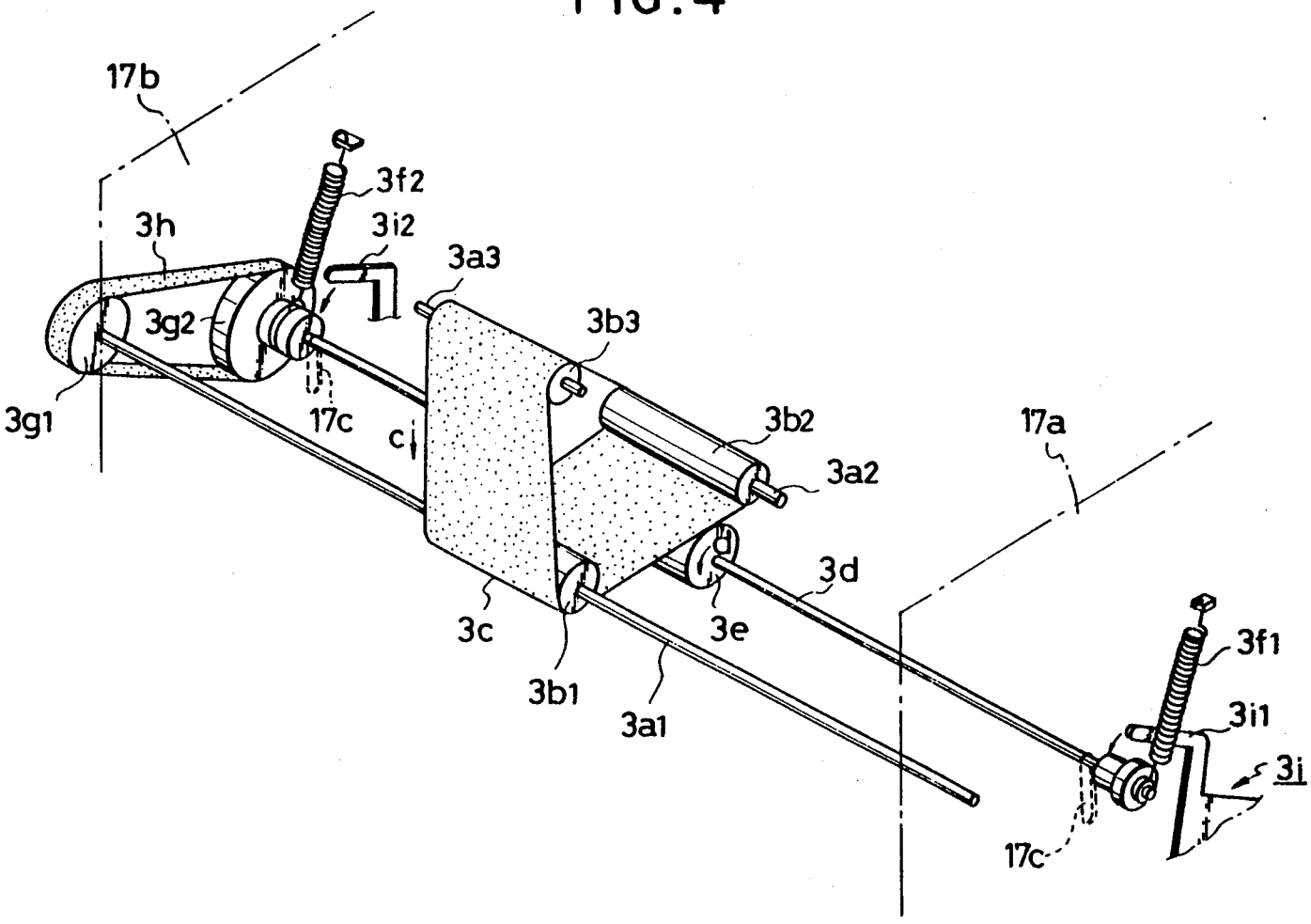
FIG. 4 illustrates a supply belt and separation roller.

The structure of the paper supply means 3 is shown in FIG. 2(B) and FIG. 4. Supply-discharge rollers 3b1, 3b2 and 3b3 are fixed to axes 3a1, 3a2 and 3a3, respectively, which are rotatively supported by side chassis 17*a* and 17*b*. An endless supply-discharge belt is supported by the supply-discharge rollers. Axis 3a1 is connected with a supply-discharge gear (to be described later) and to which rotary power is transmitted. Thus, the supply-discharge belt 3*c* rotates in the direction of arrow c in FIG. 4. Below the supply-discharge roller 3b2 is a separation roller 3*e* fixed to a rotative axis 3*d* and pressed against the supply-discharge belt 3*c*. Axis 3*d* is supported in extended apertures 17*c* in the side chassis 17*a* and 17*b* and moves upwardly and downwardly as shown in FIG. 4. The axis 3*d* is pulled in the direction of the supply-discharge belt 3*c* by tug springs 3f1, and 3f2 attached to the ends thereof. These springs bring the separation roller 3*e* in pressure contact with supply-discharge belt 3*c*. To transmit a driving force to the separation roller 3*e*, an endless rubber belt 3*h* is positioned about a pulley 3g2, which is attached to the axis 3*d* of the separation roller, and a pulley 3g1, which is attached to the axis 3a1. Rotation of the axis 3a1 transmits driving force to the belt 3*c* and also serves to rotate the axis 3*d* of the separation roller in the direction of arrow d through the belt 3*h* and the separation roller 3*e*. In addition, a friction clutch (not shown) attached between the axis 3*d* and the pulley 3g2 limits the amount of torque transmitted to the separation roller 3*e*. Therefore, when the separation roller 3*e* moves upward and the recording sheets 1 are pressed against the supply-discharge belt 3*c*, rotary power is transmitted to the axis 3a1 and the supply-discharge belt 3*c* rotates in the direction of arrow c to send forth a recording sheet 1 from the top of the stack, and the separation roller 3*e* rotates in the direction of arrow d to separate the rest of the recording sheets from the top sheet. In the above situation, the force of the supply-discharge belt 3*c* for transporting the top sheet is set at a higher level than the rotary power transmitted by the friction clutch to the separation roller 3*e*. Therefore, if recording sheets 1 are forwarded one atop the other, the separation roller 3*e* rotates in the direction opposite to the direction of movement of the top recording sheet and the supply-discharge belt 3*c*.

The tug force of springs 3f1 and 3f2 is so set that the tug force of spring 3f2, where the rubber belt 3*h* is disposed, is less than that of spring 3f1, which is provided on the other end of the axis 3*d*. The reason for that is since the rubber belt 3*h* has a certain tension between pulleys 3g1 and 3g2 to transmit driving force to the separation roller 3*e* as discussed above, the end of the separation roller axis 3*d* on the side of the belt 3*h* has an additional force created by the tension in the direction of the supply-discharge belt 3*c*. Therefore, factoring in that tension, the tug forces of springs 3f1 and 3f2, which are fixed at both ends of the axis 3*d*, are set so that a relation $F2+F3=F1$ is maintained in which F2 is the tug force of the spring 3f2, F1 is the tug force of the spring 3f1 and F3 is the tug force of the rubber belt 3*h*. Under such conditions, the separation roller 3*d* is brought into uniform pressure contact with the supply-discharge belt 3*c* so that the recording sheet 1 is reliably separated one by one and sent to the platen 4 without skewing.

Figure 2:
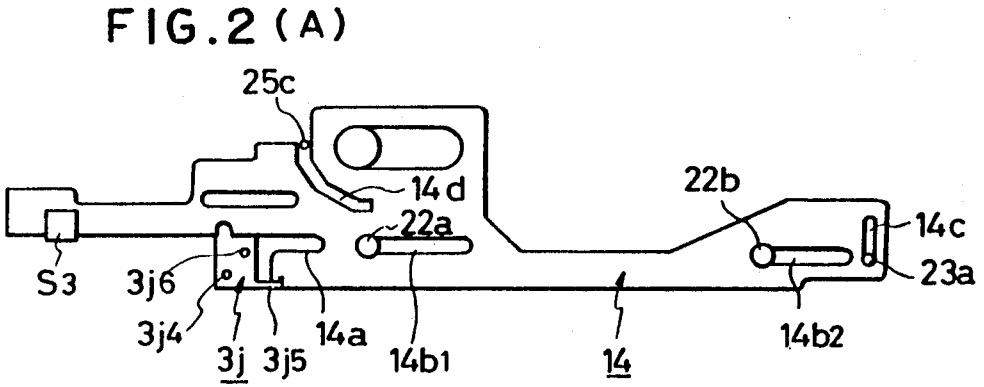
FIGS. 2(A) and 2(B) are sectional views of the apparatus during recording.
Figure 2:
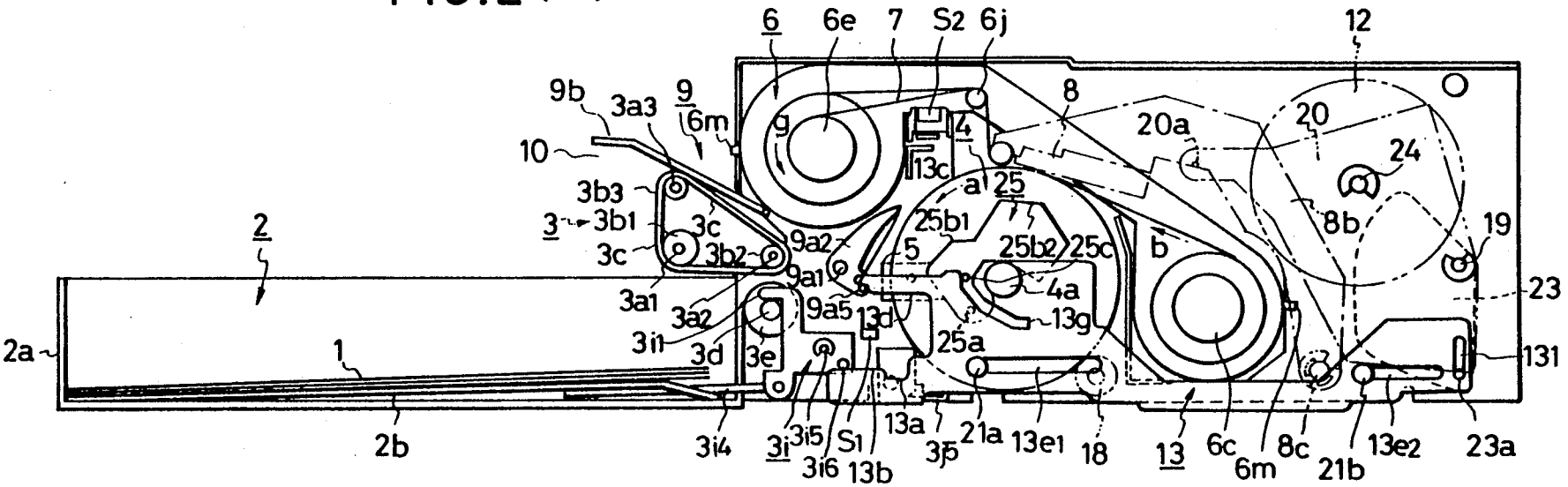
Figure 3:
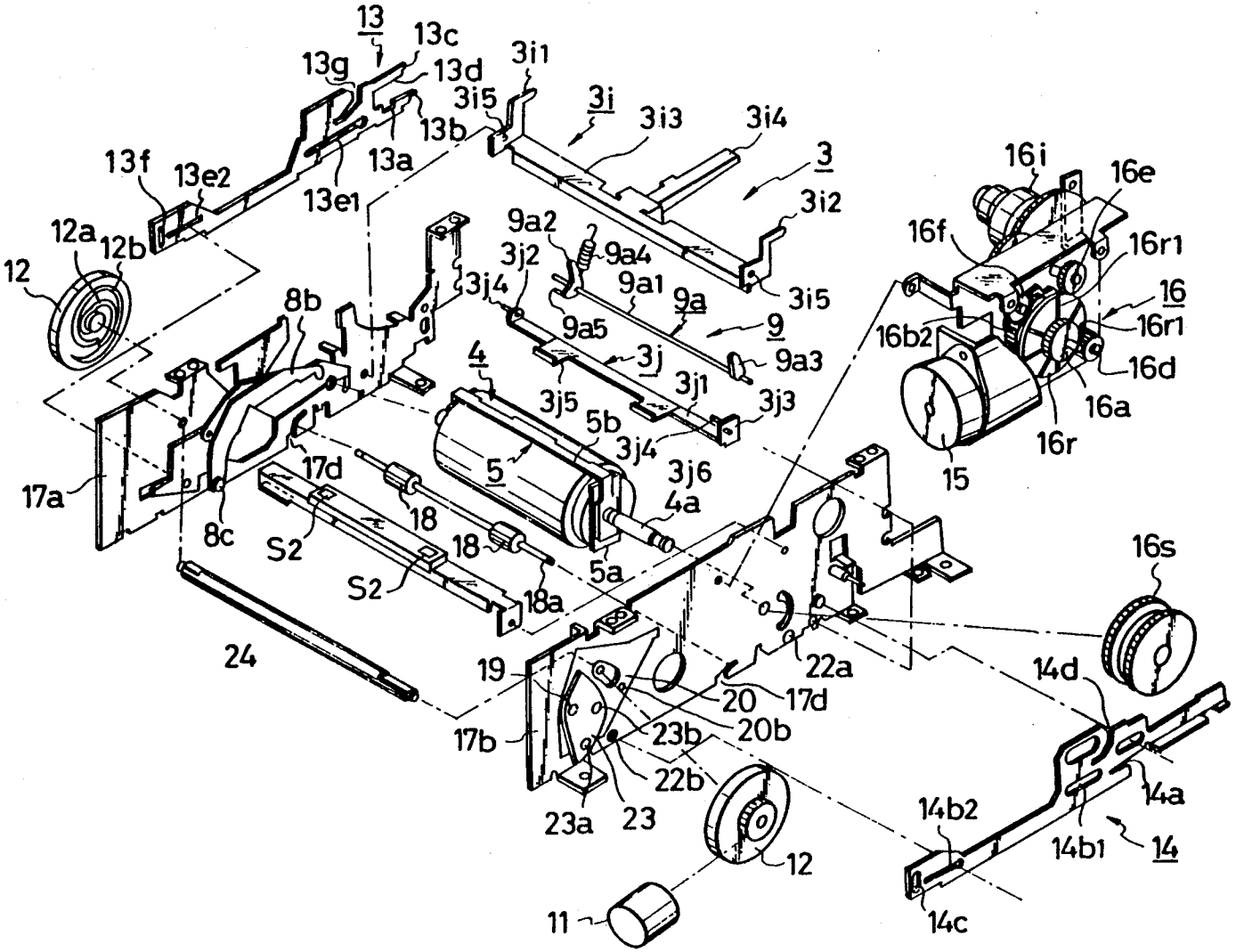
FIG. 3 is an exploded view of the apparatus.
Figure 16:
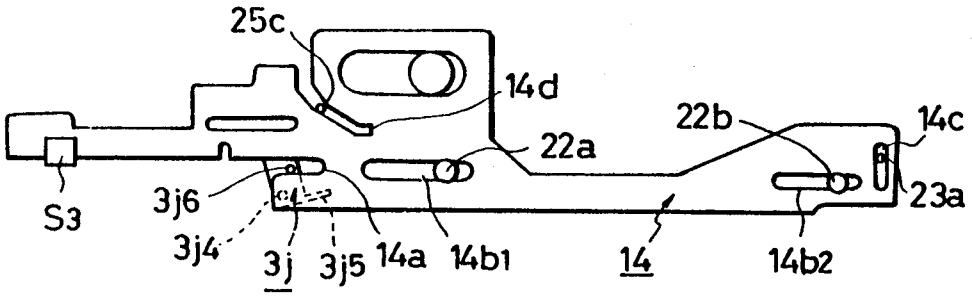
FIGS. 16(A) and 16(B) are sectional views of the apparatus during another switching stage.
Figure 16:
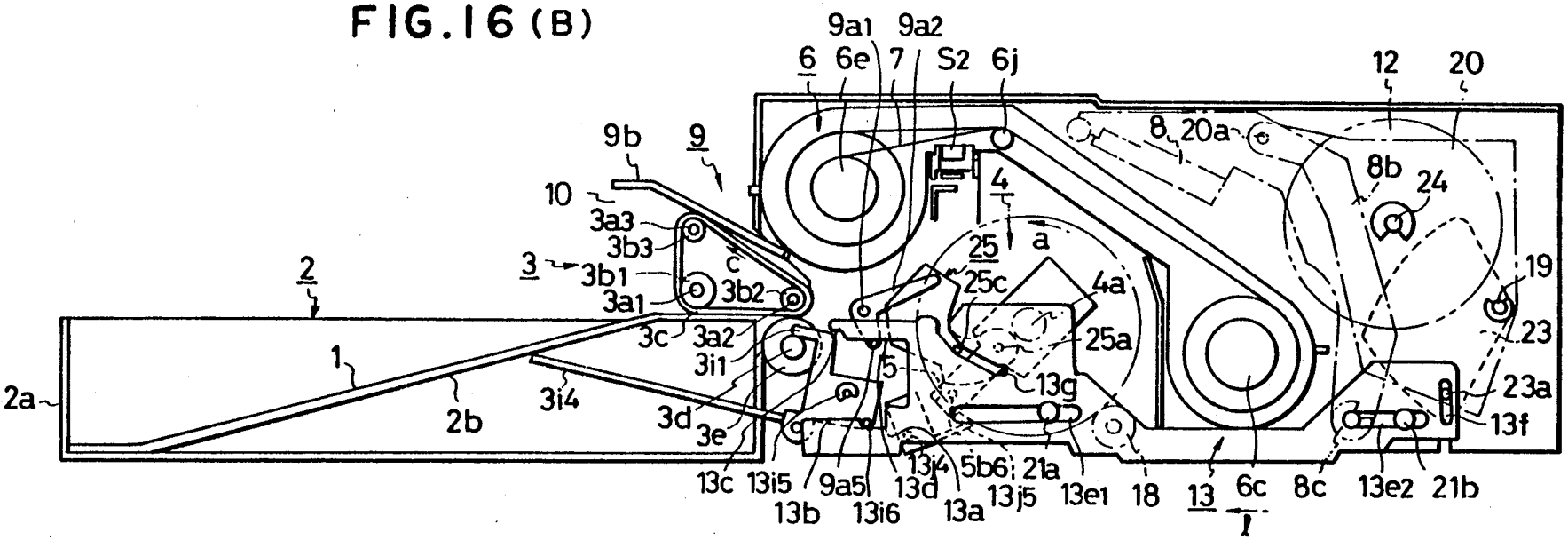

The structure that detaches the separation roller 3*e* from the supply-discharge belt 3*c* will be described. Near the separation roller 3*e*, a supply board 3*i* is provided and rotates to bring the separation roller 3*e* in and out of contact with the supply-discharge belt 3*c*. More specifically, crank-form parts 3i1 and 3i2 that engage with the separation roller axis 3*d* are fixed to both ends of connecting part 3i3 as shown in FIG. 2(B) and FIG. 3. A sheet thruster 3i4 is attached about the center of the connection part 3i3 by a spring which is not shown. The engaging parts 3i1, and 3i2 are rotatively fixed to side chassis 17*a* and 17*b* by axis 3i5. At one engaging part 3i1, a cam projection 3i6 is provided. Accordingly, when projection 3i6 is positioned at the first engaging part 13*a*, which is an indented part of a first moving cam 13, as shown in FIG. 16(B), engaging parts 3i1 and 3i2, which engage with the separation roller axis 3*d*, rotate clockwise around the axis 3i5 by a tug force of the springs 3f1 and 3f2 as shown in FIG. 4 and the separation roller 3e is brought in pressure contact with the belt 3c as shown in FIG. 16B. Further, when the straight motion cams 13 and 14 slide to the position shown in FIG. 17, the projection 3i6 is thrust by a rising part 13h of the first cam 13 and the board 3i rotates further in the clockwise direction. At this time, the thruster 3i4 for sheets also rotates clockwise to thrust the sheet rest 2b which is within the cassette 2. Consequently, the recording sheet 1 which is placed on the sheet rest 2b bumps against the belt 3c and is sent forth by its rotation. When a sheet is supplied, the change of the sheet rest position due to the differing amount of the recording sheets is absorbed by a spring which is not shown.

On the other hand, when the projection 3i6 is positioned at the second engaging part 13b of the first straight motion cam 13, the board 3i is rotated counterclockwise around the axis 3i5 and pushes down the separation roller axis 3d. Accordingly, the separation roller 3e is detached from the belt 3c and at the same time the sheet rest 2b moves down and the recording sheets 1 are separated from the belt 3c as illustrated in FIG. 2. In that situation, if the belt 3c rotates, recording sheets 1 are not supplied from cassette 2 into the apparatus.

The recording sheets which are sent forth by the belt 3c one by one are detected by an edge detecting sensor Si and eventually positioned with their leading edge against a register part 3j.

As illustrated in FIG. 3, the register part 3j has a swing board 3j1 with both ends bent to form side boards 3j2 and 3j3. The side boards 3j2 and 3j3 are rotatively fixed to the side chassis 17a and 17b, respectively, by axes 3j4 as shown in FIGS. 2(A) and (B) and FIG. 3. Further, a pressure contact 3j5, which is a U-shaped leaf spring (e.g. a phosphoric bronze board), is fixed around the center of the swing board 3j1, and when the board 3ji swings, a tip of the pressure contact 3j5 is brought into contact with the surface of the platen 4.

Figure 5:
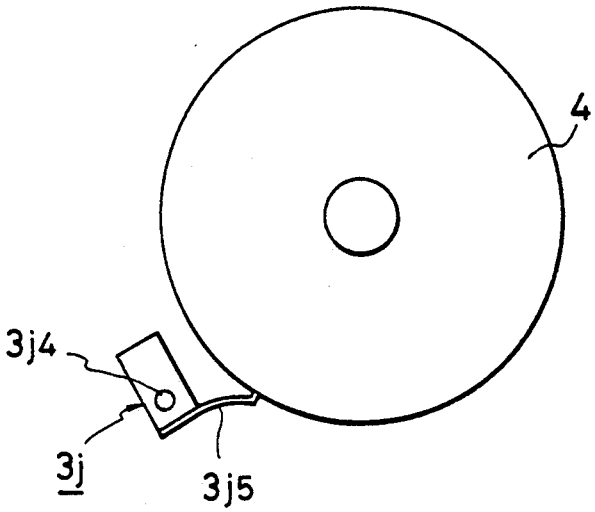
FIG. 5 illustrates a register portion in pressure contact with a platen.

The swinging of the board 3j1 is caused by the second straight motion cam 14. More specifically, a projection 3j6 extends from the side board 3j3 and runs into the engaging part 14a of the second straight motion cam 14 as shown in FIG. 16(A). When the swing board 3j1 rotates counterclockwise around the axis 3j4, the tip of the pressure contact 3j5 is brought into pressure contact with the platen 4. When the projection 3j6 is not engaged with the engaging part 14a, the swing board 3j1 rotates clockwise around the axis 3j4 under its own weight and the pressure contact 3j5 is detached from the platen 4. Since the pressure contact 3j5 is a leaf spring, it is elastically bent as shown in FIG. 5 when it is brought into pressure contact with the platen surface. Thus, the tip of the pressure contact is reliably brought into contact with the platen 4. Accordingly, the leading edge of the recording sheet 1 sent forth by the belt 3c is brought into contact with pressure contact 3j5. Further, the pressure contact 3j5 is U-shaped and each tip contacts a point on the platen 4 parallel to the direction of its axis. Consequently, if the recording sheet 1 is non-aligned, when its leading edge is brought into contact with the two points of the pressure contact tips, the leading edge becomes parallel to the direction of the platen axis and its position is thus aligned.

After the recording sheet 1 is sent forth to the platen 4 by the paper supply means 3 and the position of its leading edge is aligned, it is held against the platen surface by the gripper 5 and further forwarded.

Figure 6:
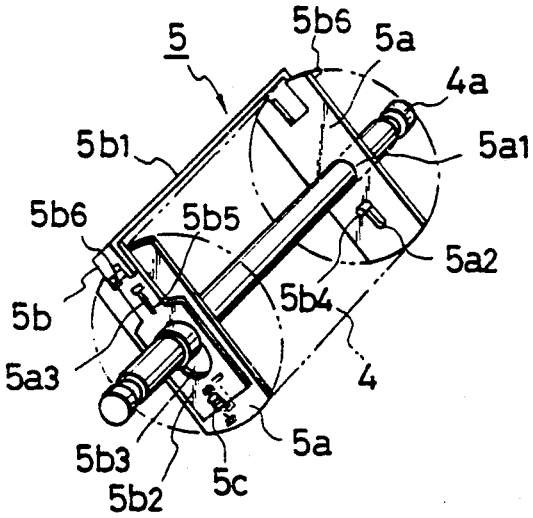
FIG. 6 illustrates a gripper.

The following description relates to the structure of the forwarding means, including the platen 4 and the gripper 5: The platen 4 is a cylinder around which rubber is provided and has a rotary axis 4a projecting from both ends. The axis 4a is rotatively fixed to the side chassis 17a and 17b. A gear, provided at one end of the axis 4a, is connected through a gear train or belt with a platen gear 16c of a clutch means 16 which is described later. A rotary force is transmitted through the clutch means 16. Consequently, the platen 4 rotates in the direction of arrow a in FIG. 2(B). The gripper 5 is attached to the platen 4 as a single body. As shown in FIG. 6, the gripper 5 comprises base boards 5a which are attached to both ends of the platen 4, and a U-shaped grip board 5b which comes in pressure contact with the surface of the platen 4 and can also be detached from it. The base boards 5a have centrally located openings 5a1 for passing the platen axis 4a therethrough. The grip board 5b consists of a grip portion 5b1 and two side-portions 5b2. Both side-portions 5b2 have oval openings 5a3 through which the platen axis 4a extends. Engaging projections 5b4 are provided on both side portions and pass through guiding openings 5a2 in base boards 5a. The base boards include sliding projections 5a3 which project through oval slide openings 5b5 in the side portions 5b2. Cam projections 5b6 for engaging with a gripper cam and detaching the gripper 5b1 from the platen surface are provided on both side-portions 5b2.

When the gripper 5 is fixed to the platen 4, slide projections 5a3 of base boards 5a are passed through the slide openings 5b5 and the engaging projections 5b4 are passed through the guiding openings 5a2 of base boards 5a. Further, the platen axis 4a is passed through round openings 5a1 in the base boards 5a and oval openings 5b3 in the grip board 5b and thus the gripper 5 is fixed to the platen 4. Therefore, base boards 5a and the grip board 5b are rotatively supported as one body around the platen axis 4a and the grip board 5b can slide in the radial direction of the platen. Additionally, between base boards 5a and grip board 5b, springs 5c are attached to create a force on the grip board 5b in the direction of the platen axis 4a. Accordingly, the grip 5b1 is in pressure contact with the platen surface.

On both sides of the platen 4, circular grooves 4b are cut. Engaging dents 4b1 are cut out of the grooves, and the engaging projections 5b4 of the grip board 5b extend within the grooves as shown in FIGS. 7(A) and (B).

Figure 7:
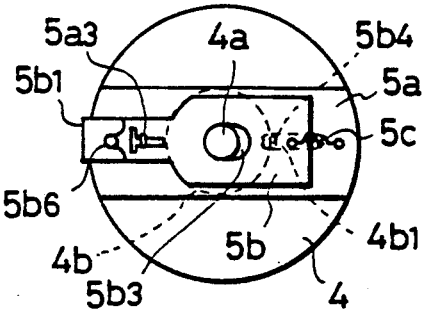
FIGS. 7(A) and (B) show the relation between the gripper and the platen.
Figure 7:
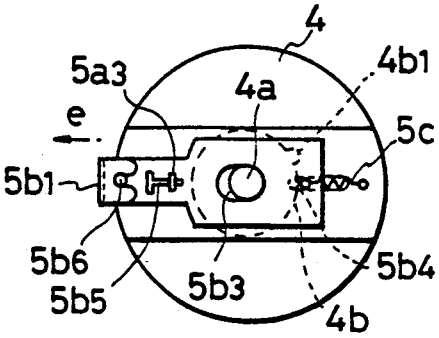

Accordingly, when the engaging projections 5b4 are placed in the engaging dents 4b1 as shown in FIG. 7(A), the grip 5b1 is in pressure contact with the surface of the platen 4 and the gripper 5 rotates along with the platen 4. On the other hand, when the grip board 5b is pulled against the force of the spring 5c in the direction of arrow e, as shown in FIG. 7(B), the projections 5b4 are displaced from the dents 4b1 and when the platen 4 rotates the engaging projections 5b4 rest on the inner circle of the circular grooves 4b. Accordingly, in this situation, the grip 5b1 is separated from the surface of the platen 4 and only the platen 4 rotates until the projections 5b4 engage within the grooves 4b1. In this way, the platen 4 and the gripper 5 have one mode where both of them rotate together as a single body, and a second mode in which only the platen 4 rotates. Although the platen 4 and gripper 5 have two modes, they are constructed solidly in one unit. Therefore, the gripper's position with respect to the platen 4, is precisely maintained. When the leading edge of the recording sheet 1 is gripped by the gripper 5 against the platen 4 and the platen 4 rotates, the recording sheet 1 is forwarded along the surface around the platen 4. Further, pinch rollers 18 which work as a pressing means are in pressure contact with the platen surface as shown in FIG. 2(B). If the recording sheet 1 is not held by the gripper 5, for example, at the time of sheet discharge (to be described later), the recording sheet 1 can be forwarded by the rotation of the platen 4. The pinch rollers 18 are divided on a roller axis 18*a* as shown in FIG. 3 and FIGS. 8(A) through 8(C), and both ends of the roller axis 18*a* fall into extended slots 17*d* in side chassis 17*a* and 17*b* and are rotatable therein. Further, both ends are pulled by tug springs 18*b* in the direction of the platen 4. Accordingly, the roller axis 18*a* can slide within the long slots 17*d* so that pinch rollers 18 can either be brought into pressure contact with the surface around the platen 4, or can be separated from it.

Figure 8:
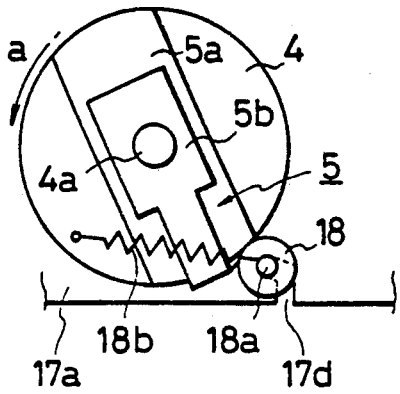
FIGS. 8(A)-(C) show a pinch roller in connection with rotation of the gripper.
Figure 8:
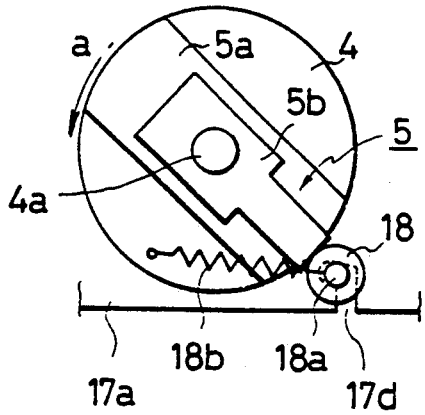
Figure 8:
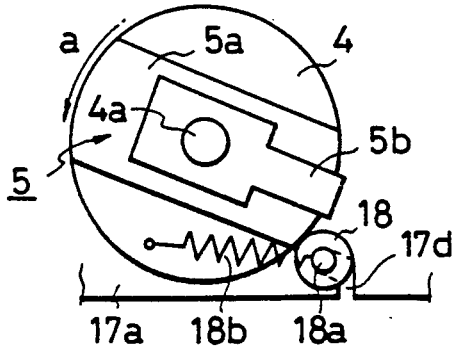

When the recording sheet 1 is gripped by the gripper 5, the platen 4 rotates and as the gripper 5 passes through the contact portion between the platen 4 and pinch rollers 18 as shown in FIGS. 8(A) through (C), the rollers 18 run onto the gripper 5. The rollers 18 come in contact with the platen 4 again by the force of springs 18*b* after the gripper 5 passes through the contact portion with the rollers 18. Therefore, according to the present embodiment, pinch rollers 18 do not obstruct the rotation of the gripper 5, even without special means for pulling back the pinch rollers 18 from the platen 4 while the gripper 5 is rotating through the contact portion. As discussed above, the recording sheet 1 which is forwarded by the platen 4 is brought into contact with the ink sheet 7 by pressure contact from the recording heads 8 and recording is performed.

The structure of the recording heads 8 will now be described.

Figure 9:
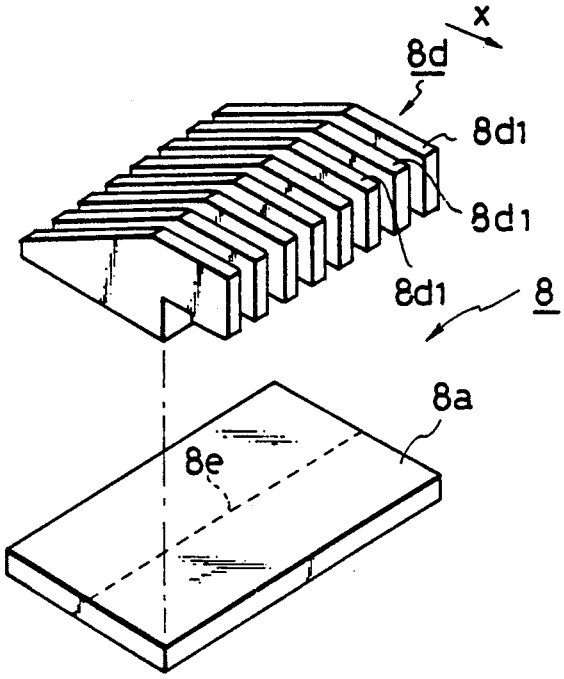
FIGS. 9(A) and (B) illustrate formation of the recording heads and a radiator.
Figure 9:
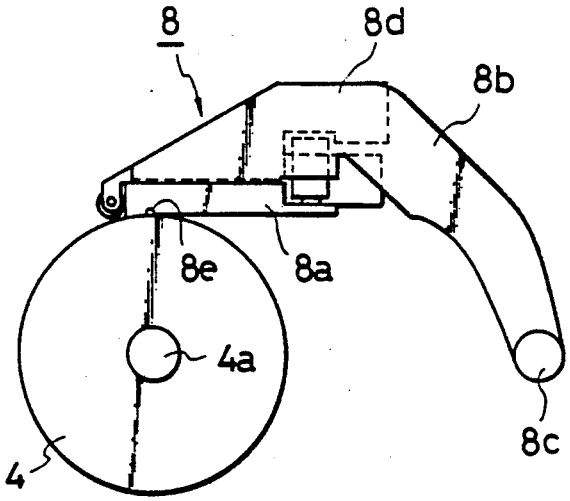

The thermal recording heads 8 shown in FIGS. 9(A) and 9(B) include a plurality of heat elements 8*e* lined in a row on the surface of a base plate 8*a*. The heat elements 8*e* generate heat by applying electric current according to image signals. The base plate 8*a* is supported at both sides by head arms 8*b* as shown in FIG. 9(B), and the arms 8*b* are rotatively fixed to the side chassis 17*a* and 17*b* by an arm axis 8*c*. As shown in FIG. 2(B), each head arm 8*b* is connected by an axis 20*a* to a head moving board 20 which is rotatively fixed to the side chassis 17*a* and 17*b* by a rotating axis 19. Accordingly, when the head moving board 20 swings, the head arm 8*b* swings to bring recording heads 8 in and out of contact with the surface of the platen 4. The head moving board 20 swings by movement of a rotating cam, which will be described later. To the recording heads 8 is attached a radiating element 8*d* for preventing the base board 8*a* from accumulating heat. The radiating element 8*d* is attached to the back of the base board 8*a* as shown in FIGS. 9(A) and (B) and is made of materials such as aluminum which have good heat radiating characteristics. The radiating element 8*d* has a plurality of fins 8d1 to increase the radiating surface area. Additionally, the radiating element 8*d* is constructed longer in the direction of arrow x of FIG. 9(A) (which is the direction perpendicular with the line of heat elements 8*e*) than the base board 8*a* so that when the radiation element is placed on the back of the base board, a portion of the fins 8d1 protrudes from the base board 8*a* in the direction of the arrow x. When the radiating element 8*d* is constructed broader than the base board 8A, the area for radiating heat increases and its effectiveness is improved. This enables clearer images to be formed.

Figure 10:
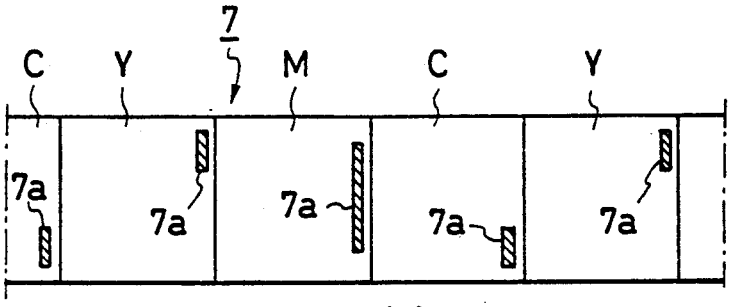
FIG. 10 illustrates an ink sheet.
Figure 11:
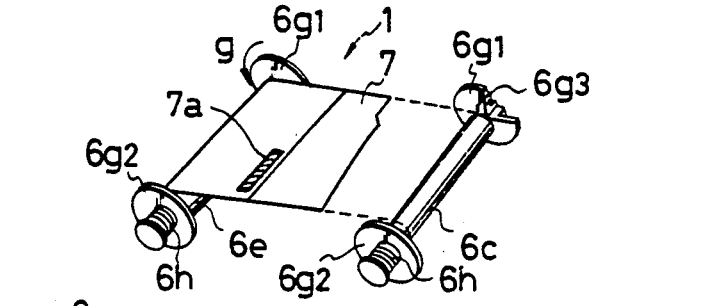
FIGS. 11(A) and (B) illustrate an ink cassette.
Figure 11:
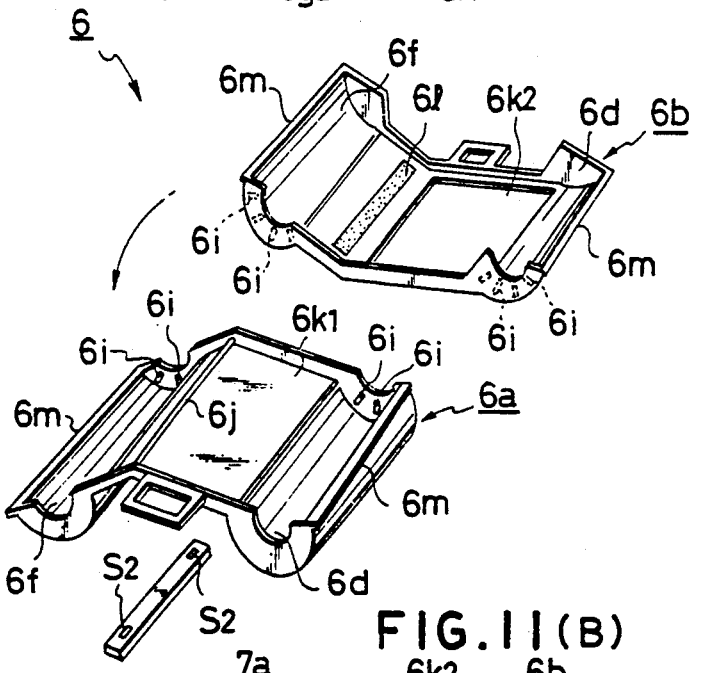
Figure 11:
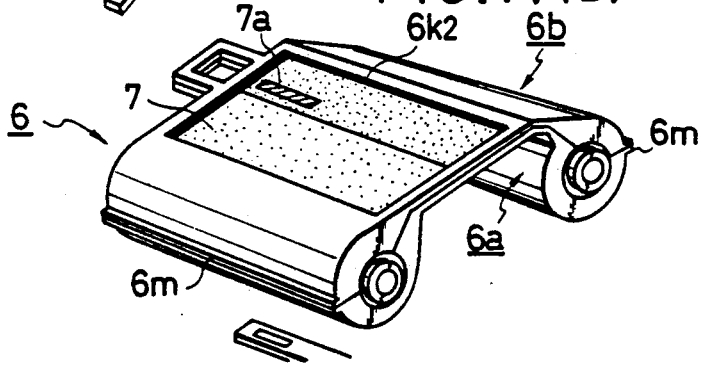

The following discussion relates to the ink sheet 7, which is selectively heated by the recording heads 8, and the ink cassette 6 for storing the ink sheet 7 as shown in FIGS. 10, 11(A) and (B). The ink sheet 7 is made by coating heat transfer ink (which has a heat melting characteristic, heat sublimation characteristic or the like) on a base film having almost the same width as the recording heads 8 in the direction of the heat element 8*e*. Additionally, in the ink sheet 7 of the present embodiment, each color ink of yellow Y, magenta M and cyan C coats a portion of the ink sheet as shown in FIG. 10, and a mark 7*a* is affixed on the border between each color ink for distinguishing that color. As to the ink cassette 6 for storing the ink sheet 7, a container body 6*a* and a case 6*b* are fitted together to constitute the container as shown in FIGS. 11(A) and (B). At one end of the container is formed a reel holding portion 6*d* for a supply reel 6*c* and the other end is a reel holding portion for a winding reel 6*e*. Accordingly, the ink sheet 7 is wound on the supply reel 6*c* and wind reel 6*e* and the reels 6*c* and 6*e* are put in the holding portions 6*d* and 6*f*, respectively, to form the ink cassette.

The ink cassette 6 has an engaging projection 6*m* on an external portion of the container. The ink cassette 6 is set in the apparatus by inserting it into the body and engaging the projection 6*m* with a corresponding portion of the body. On both sides of the supply reel 6*c* and wind reel 6*e*, brims 6g1 and 6g2 are fixed. Engaging projections 6g3 are provided on outer portions of brims 6g1, and pressure springs 6*h* are provided on the outer portions of brims 6g2. On the interior sides of reel holding portions 6*d* and 6*f* facing the brims 6g1, engaging dents 6*i* are radially formed with which the projections 6g3 engage. Accordingly, the reels 6*c* and 6*e* held within the container are pressed to one side by the springs 6*h* and the projections 6g3 engage with the dents 6*i* so that reels 6*c* and 6*e* do not rotate and the ink sheet 7 does not loosen when the ink cassette 6 is transported.

When the ink cassette 6 is set into the recording apparatus body, brims 6g1 are pushed in the direction of arrow f in FIG. 11(A) by a projection portion within the apparatus (not shown in the figures) and by a winding gear 16*i*, so that the projections 6g3 are disengaged from the dents 6*i* and the reels 6*c* and 6*e* become rotatable. At this time, the wind reel 6*e* is connected with a winding gear 16*e* of the clutch 16. When rotary force is transmitted to the winding gear 16*e*, the wind reel 6*e* begins to rotate in the direction of arrow g to draw the ink sheet from the supply reel 6*c* as shown in FIG. 11(A). The ink cassette is constructed to be angled so that a transport path of the ink sheet from the supply reel 6*c* to the wind reel 6*e* is angled. Further, the bending portion of the container body 6*a* has a guiding element 6*j* attached thereto for guiding the ink sheet 7 through the container. The container body 6*a* and cover 6*b* have windows for exposing the ink sheet 7, and through which the exposed ink sheet 7 is brought into contact with the recording sheet 1 by the pressure of the recording heads 8. A reflecting plate 61 is attached to an inside surface of the case 6*b*. When the ink cassette 6 is set in the recording apparatus body, the plate 61 reflects the light from a light emitting element of an ink sensor $S_2$, which is fixed to the side chassis 17A and 17B under the container body 6a as shown in FIG. 3 and FIG. 11(A). The light from the ink sensor $S_2$ passes through the window 6k1 of the container body 6a and through the ink sheet 7 to the reflecting plate 61. Accordingly, the presence of the tip mark 7a for each ink sheet color is detected by the reflecting light.

The ink cassette 6 according to the present embodiment is angled so that the height of the apparatus body is relatively low when the ink cassette 6 is set in the recording apparatus as shown in FIGS. 1 and 2(B), and thus the apparatus can be made small in size. Further, a part of the ink cassette 6 functions as a guide for discharging the recording sheet 1. The recording sheet 1 is discharged by a discharging means 9 after ink from the ink sheet 7 is transferred onto the recording sheet 1 by the heat of the recording heads 8 and recording is finished.

With reference to FIGS. 2(B) and 3, the discharging means 9 has a discharge lever 9a for leading the recording sheet 1 from the platen surface to a discharging outlet 10 and has a guide element 9b for discharging the recording sheet 1 in collaboration with the supply-discharge belt 3c. In the discharge lever 9a, levers 9a2 and 9a3 are fixed at both ends of an axis 9a1 with the axis being a little longer than the width of the rubber surface of the platen 4 and substantially the same s the width of the recording sheet. The axis 9a1 is rotatively fixed to the side chassis 17a and 17b. Further, one of the lever elements, 9a2, is an L-shaped lever and is pulled counterclockwise in FIG. 2(B) by the force of a tug spring 9a4. Additionally, the lever 9a2 is provided with a cam projection 9a5 and is pulled against the force of the spring 9a4 and away from the platen 4 when it engages with a third rest 13c of the first straight motion cam 13 as shown in FIG. 2(B). Meanwhile, when the projection 9a5 engages with the fourth rest 13d as shown in FIG. 16(B), the discharge lever 9a rotates clockwise and levers 9a2 and 9a3 are positioned near both ends of the platen 4. Accordingly, when the recording sheet 1 is released from the hold of the gripper 5 and is forwarded by the rotation of the platen 4, a leading edge of the sheet is led to the discharge outlet 10, with both ends being guided by the levers 9a2 and 9a3.

Figure 12:
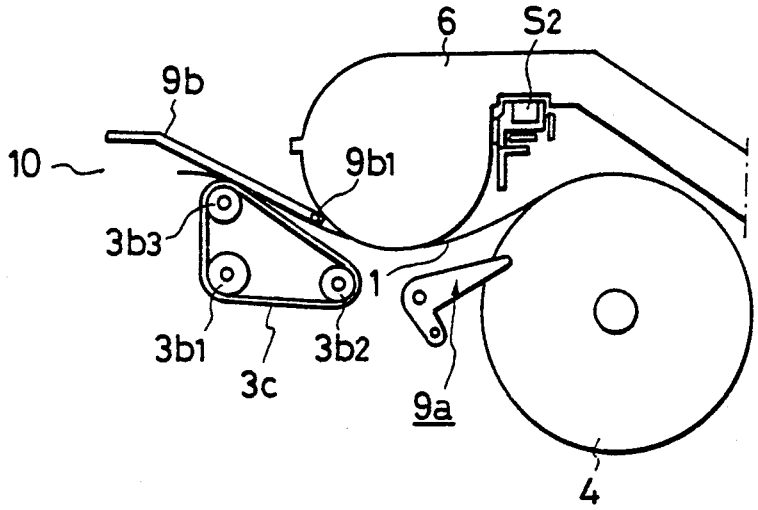
FIG. 12 shows a discharge guide.

A guiding element 9b is made wider than width of the recording sheet 1 and is placed over the supply-discharge belt 3c as shown in FIGS. 2(B) and 12. The guiding element 9b is rotatively fixed by an axis 9b1 to the side chassis 17a and 17b, and a portion of element 9b contacts the belt 3c with pressure around 10–40 gf/cm$^2$ by its own weight. Therefore, the recording sheet 1, which is led to an upper part of the belt 3c by the discharge lever 9a, is forwarded between the belt 3c and guiding element 9b and discharged to the discharging outlet 10.

According to the present embodiment, since the guiding element 9b can contact and press the supply-discharge belt 3c without pressure by a spring etc., transport and discharge force can be applied to the recording sheet 1 with a simple structure and without additional parts. Position control of the supply board 3i, register element 3j, discharge lever 9a, recording heads 8 and gripper 5 is carried out by a cam which is a position control element.

The following description is directed to the relation between the above-mentioned parts and a cam element. As shown in FIGS. 2(B) and 3, long oval openings 13e1 and 13e2 are located in the straight motion cam 13, in which are slideably fitted axes 21a and 21b that are provided on the outer surface of one side-chassis 17a. Thus, the straight motion cam 13 is movable between ovaL openings 13e1 and 13e2. Likewise, the second straight motion cam 14 includes long oval openings 14b1 and 14b2 in which are slideably fitted axes 22a and 22b that are provided on the outer surface of the other side-chassis 17b. In this way, the second straight motion cam 14 is movable between openings 14b1 and 14b2.

Figure 13:
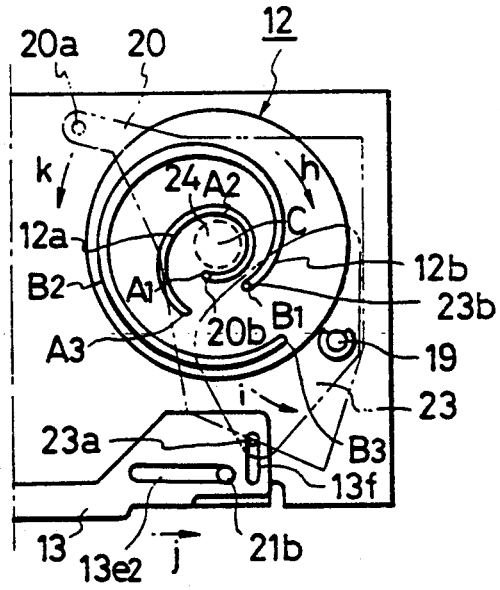
FIG. 13 shows the relation between a rotating cam, recording heads and a straight motion cam.

Furthermore, the ends of the first straight motion cam 13 and second straight motion cam 14 include long oval openings 13f and 14c, respectively, through which a projection 23a of a cam moving board 23 extends. The moving board 23 is rotatively fixed to both side-chassis 17a and 17b about an axis 19 which also serves as the rotary axis of the head moving board 20 discussed earlier. The cam moving board 23 and head moving board 20 are rotated by a rotary cam 12 which is rotatively fixed to both side-chassis 17a and 17b about an axis 24. The rotary cam includes two cam grooves 12a and 12b formed in the inner side of the rotary cam 12 as shown in FIGS. 3 and 13. Into one cam groove 12a is inserted a cam projection 20b which is provided in the head moving board 20, and into the other cam groove 12b is inserted a cam projection 23b which is provided in cam moving board 23. Accordingly, when the rotary cam 12 rotates, each projection 20b and 23b slides within cam grooves 12a and 12b.

The cam groove 12a which is connected with the head moving board 20 is circular from a point A1 to a point A2 at a constant distance from a rotary center C of the rotary cam 12, and from a point A2 to a point A3 the cam groove gradually increases its distance from the rotary center C. The cam groove 12b which is connected with the cam moving board 23 gradually increases its distance from the rotary center C from a point B1 to a point B2 and is circular from a point $B_2$ to a point B3 at a constant distance from the rotary center C.

Accordingly, when the rotary cam 12 rotates in the direction of arrow h in FIG. 13, the cam moving board 23 rotates in the direction of an arrow i in a zone from point B1 to point B2 and the first and second straight motion cams 13 and 14 slide in the direction of arrow j. At this time, the cam projection 20b of the head moving board 20 is positioned in a zone from point A1 to point A2, and consequently, the head moving board 20 does not rotate and the recording heads do not move.

As the rotary cam 12 continues to rotate, the cam projection 23b of the cam moving board 23 enters a zone between point B2 and point B3, and consequently, the cam moving board 23 does not rotate and the straight motion cams 13 and 14 do not slide. Meantime, the cam projection 20b of the head moving board 20 enters a zone between point A2 and point A3, and consequently, the head moving board 20 rotates in the direction of arrow k and the recording heads 8 move in a direction downward.

Additionally, when the rotary cam 12 rotates in the opposite direction, the straight motion cams 13, 14 and the recording heads 8 move in the reverse direction as described above. When the rotary cam 12 rotates and places the cam projection 20b of the head moving board 20 at the point A2, the cam projection 23b of the cam moving board 23 is at the point B2. Accordingly, cam grooves 12a and 12b are configured so that when the recording heads 8 are in motion, movement of the straight motion cams 13 and 14 is suspended, and when both straight motion cams 13 and 14 are in motion, the motion of recording heads is suspended.

Furthermore, a sensor contactor 26 is fixed to the rotary cam 12 as shown in FIG. 1, so that it can rotate with the cam 12. Two touch sensors $S_5$ are placed proximate to the contactor. When the recording heads 8 are brought to the state of head-up or head-down by rotation of the rotary cam 12, the contactor 26 contacts the touch sensors $S_5$ and indicates the state of the recording heads 8. The sliding motion of straight motion cams 13 and 14 rotates a gripper cam 25 to control a position of the gripper 5. The gripper cam 25 is fixed to both side-chassis 17*a* and 17*b* and rotates around an axis 25*a* as shown in FIG. 2. In the gripper cam 25, a first engaging part 25b1 and second engaging part 25b2 are formed for separating a gripping portion 5b1 from the surface around the platen 4, and a cam projection 25*c* is provided on the surface of the gripper cam. Further, at a certain position of the first straight motion cam 13 and second straight motion cam 14, diagonal cam grooves 13*g* and 14*d* engage with cam projections 25*c* of the gripper cam 25. Accordingly, when both straight motion cams 13 and 14 slide in the direction of an arrow 1 in FIG. 16, the cam projections 25*c* slide in cam grooves 13*g* and 14*d*, and consequently, the gripper cam 25 rotates in the direction of arrow a. Owing to the rotation of the gripper cam 25, the engaging parts 25b1 and 25b2 push up a cam projection 5b6 of the gripper 5, as described later, that is at a certain position so that the pressure contact of the gripper 5 with the platen 4 is released.

The straight motion cams 13 and 14 slide as one body owing to the rotary cam 12, as discussed above. At a tip part of the second straight motion cam 14, a straight motion cam sensor $S_3$ is provided for detecting a position of the cam 14 after its slide. When the cam 14 slides from the right to the left in FIG. 2(B), the sensor $S_3$ detects a plurality of stages, according to its slide position. According to the detection of an up or down state of the recording heads 8 by the rotary sensors S5 and detection of five stages by the straight cam sensor S3, the following six switchings are made. When the cams 13, 14 slide to the switching position as described above, the relation among the supply board 3*i*, register element 3*j*, discharge lever 9*a*, gripper cam 25, rotation of the rotary cam 12 and recording heads 8 is as follows:

(1) When the switching stage is −I (FIGS. 2(A) and 2(B))

i) supply board 3*i*

The cam projection 3i6 engages with the second engaging part 13*b* of the first straight motion cam 13 (hereinafter referred to as the "down" position).

ii) register element 3*j*

The cam projection 3j6 does not engage with the engaging part 14*a* of the second straight motion cam 14 (hereinafter referred to as the "down" position).

iii) discharge lever 9*a*

The cam projection 9a5 engages with the third engaging part 13*c* of the first straight motion cam 13 (hereinafter referred to as the "up" position).

iv) recording heads are in the state of head-down.

v) gripper cam 25 is in the state of suspension.

Switching−I is detected by the rotary sensors $S_5$.

(2) When the switching stage is I, only the recording heads 8 go up due to rotation of the rotary cam 12 and other elements remain in the state of switching stage−I.

Figure 14:
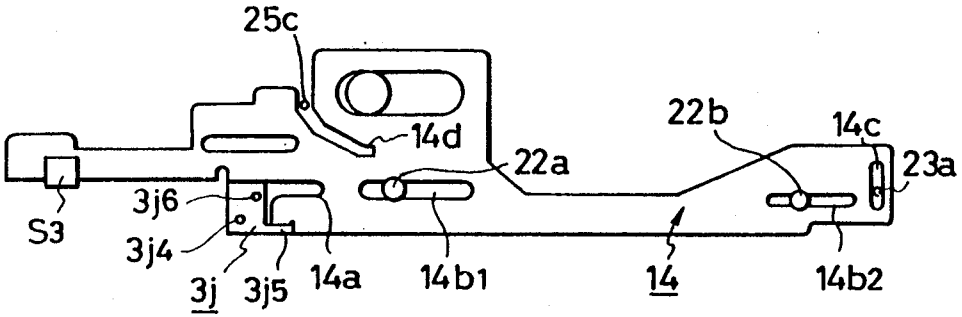
FIGS. 14(A) and 14(B) are sectional views of the apparatus during a switching stage.
Figure 14:
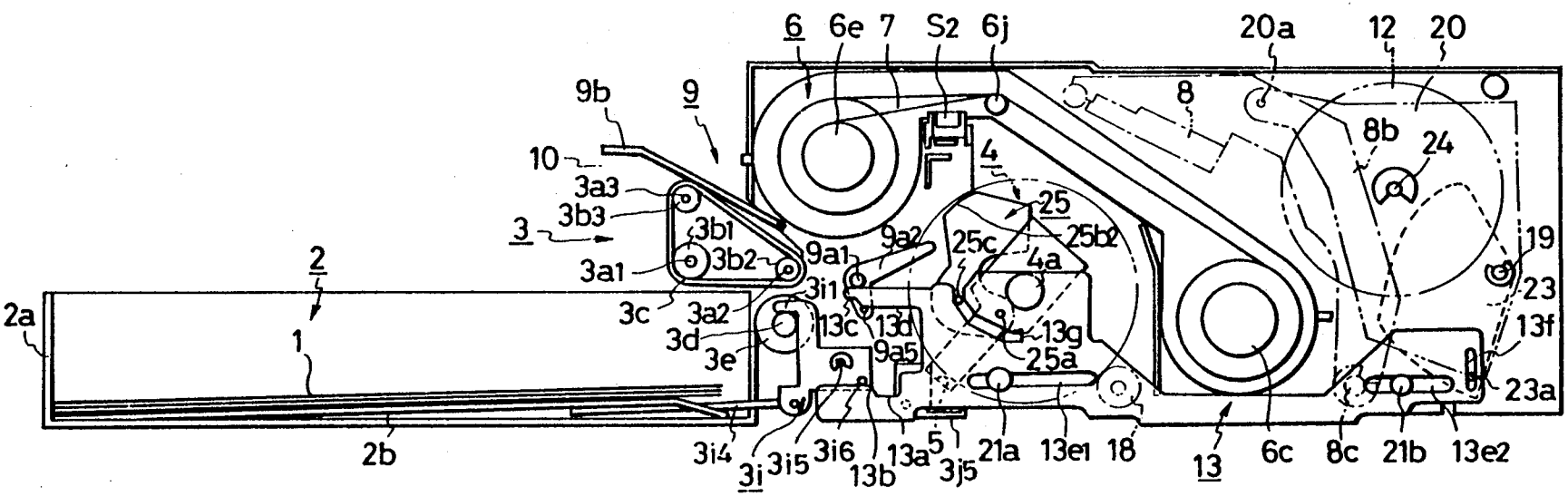

(3) When the switching stage is II, (FIGS. 14(A) and 14(B))

i) supply board 3*i* is in the down state, the same as at switching stage−I;

ii) register element 3*j* is in the down state, the same as at switching stage−I;

iii) discharge lever 9*a* the cam projection 9a5 engages with the fourth engaging part 13*d* of the first straight motion cam 13 (hereinafter referred to as the "down" position);

iv) recording heads 8 are in the state of head-up;

v) gripper cam 25 rotates counterclockwise.

Figure 15:
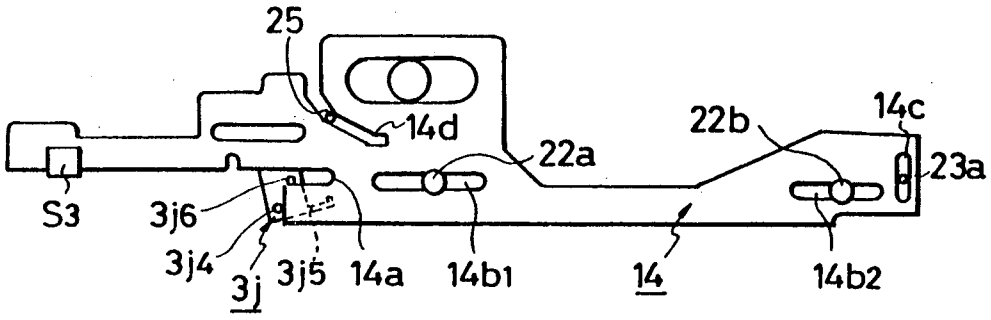
FIGS. 15(A) and 15(B) are sectional views of the apparatus during another switching stage.
Figure 15:
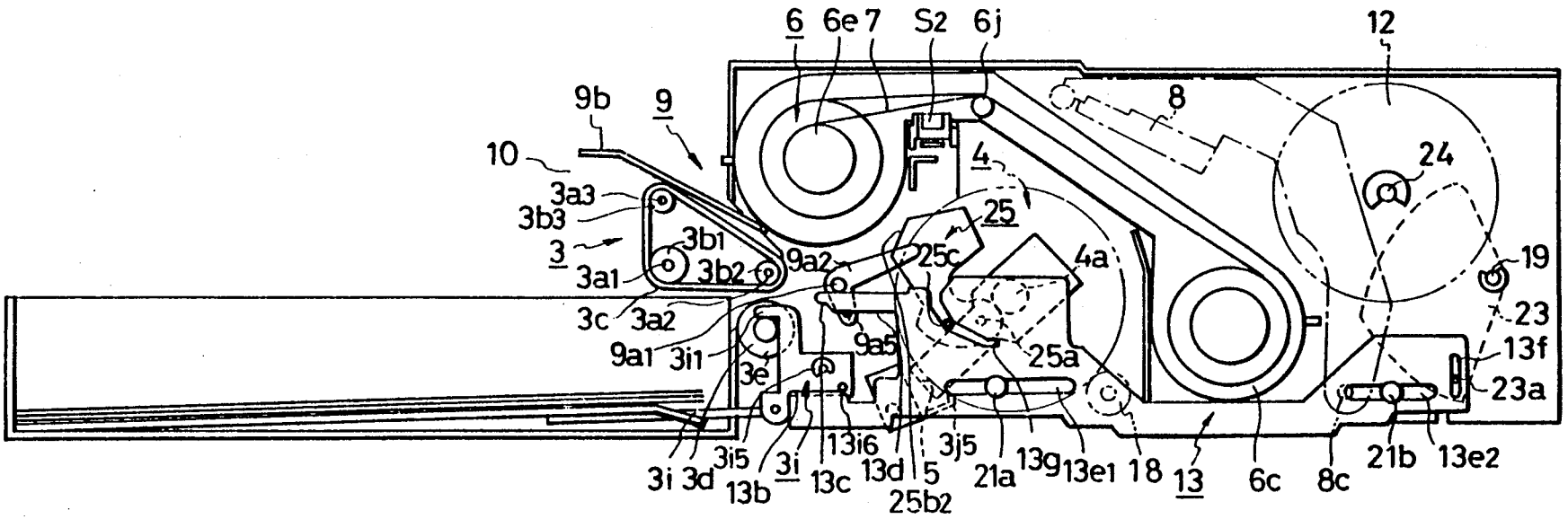

4) When the switching stage is III (FIGS. 15(A) and 15(B), i) supply board 3*i* is in the down state, the same as at switching stage−I;

ii) register element 3*j*, the cam projection 3j6 engages with the engaging part 14*a* of the second straight motion cam 14 (hereinafter referred to as the "up" position);

iii) discharge lever 9*a* is in the down state, the same as at switching stage II;

iv) recording heads 8 are in the state of head-up;

v) gripper cam 25 rotates counterclockwise.

(5) When the switching stage is IV (FIGS. 16(A) and 16(B), i) supply board 3*i*, the cam projection 3i6 engages with the first engaging part 13*a* of the first straight motion cam 13 (hereinafter referred to as the "up" stage);

ii) register element 3*j* is in the up state, same as at switching III;

iii) discharge lever 9*a* is in the down state, the same as at switching II;

iv) recording heads 8 are in the state of head-up;

v) gripper cam 25 rotates counterclockwise.

(6) When the switching stage is V (FIG. 17), i) supply board 3*i*,

The cam projection 3i6 is thrust by the rising part 13*h* of the first straight motion cam 13 and the recording sheet 1 is pressed against the supply-discharge belt 3*c* by rotation of the sheet thruster 3i4. The gripper cam 25 rotates counterclockwise and other elements remain in the state of switching stage IV.

The positions of the elements during the switching stage are collectively shown in Table 1.

TABLE 1

| cam switch | −I | I | II | III | IV | V |
|---|---|---|---|---|---|---|
| rotary cam | | | rotating | | | |
| straight motion cam | suspension | | | moving | | |
| discharge lever | up | | | down | | |
| register element | | down | | | up | |
| supply board | | | down | | | up |
| gripper cam | suspension | | | rotating | | |

TABLE 1-continued

| cam switch | −I | I | II | III | IV | V |
|---|---|---|---|---|---|---|
| recording heads | down | | | up | | |

According to the present embodiment, position control of the sheet supply means 3, recording heads 8, discharge means 9 and gripper 5 is carried out respectively by rotation of the rotary cam 12. Therefore, it is not necessary to provide a separate mechanism for operating each respective element. Consequently, not only does the number of parts and their respective cost go down, but the size of the apparatus is reduced.

Figure 20:
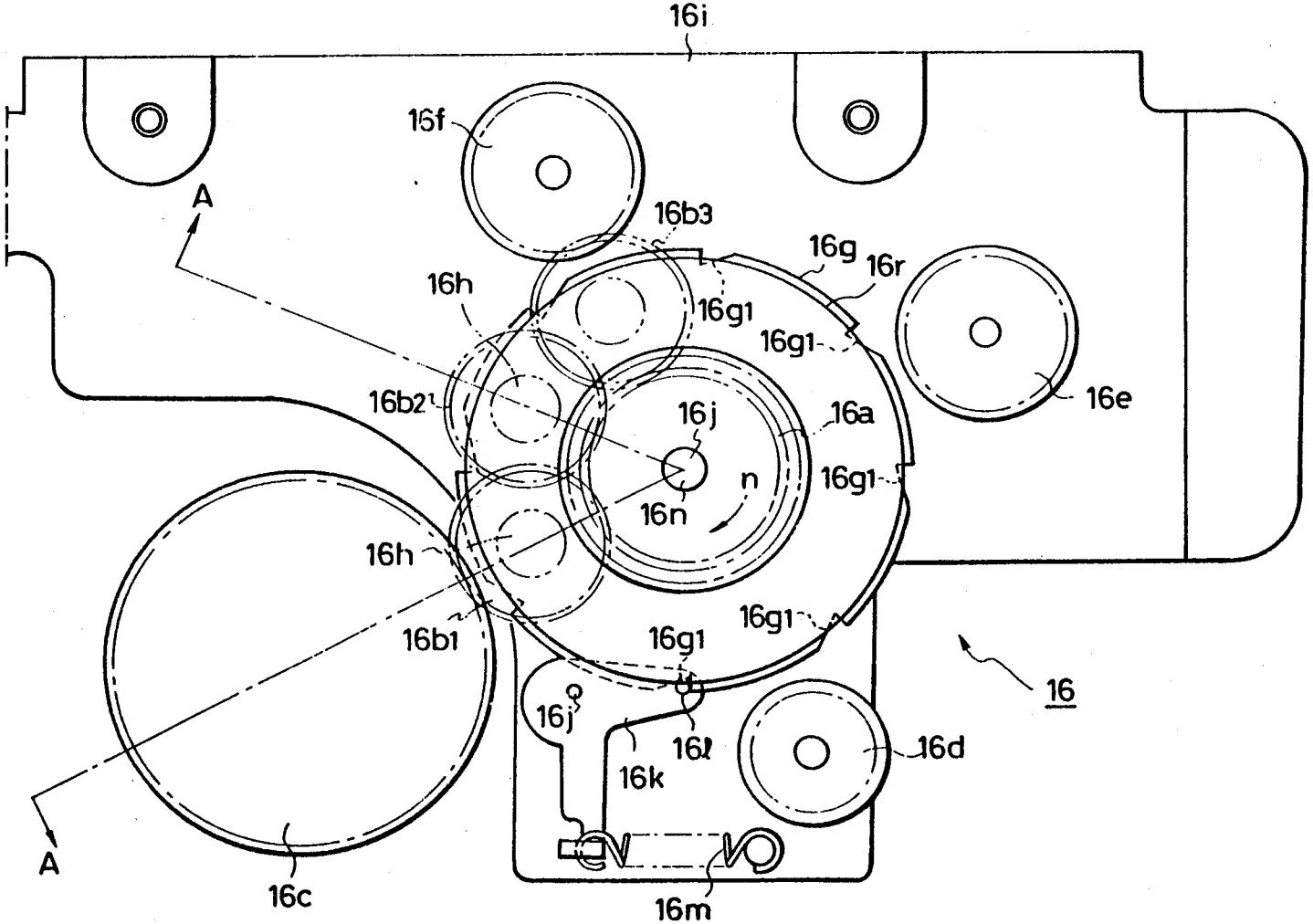
FIGS. 20 and FIG. 21 show formations of a clutch.
Figure 21:
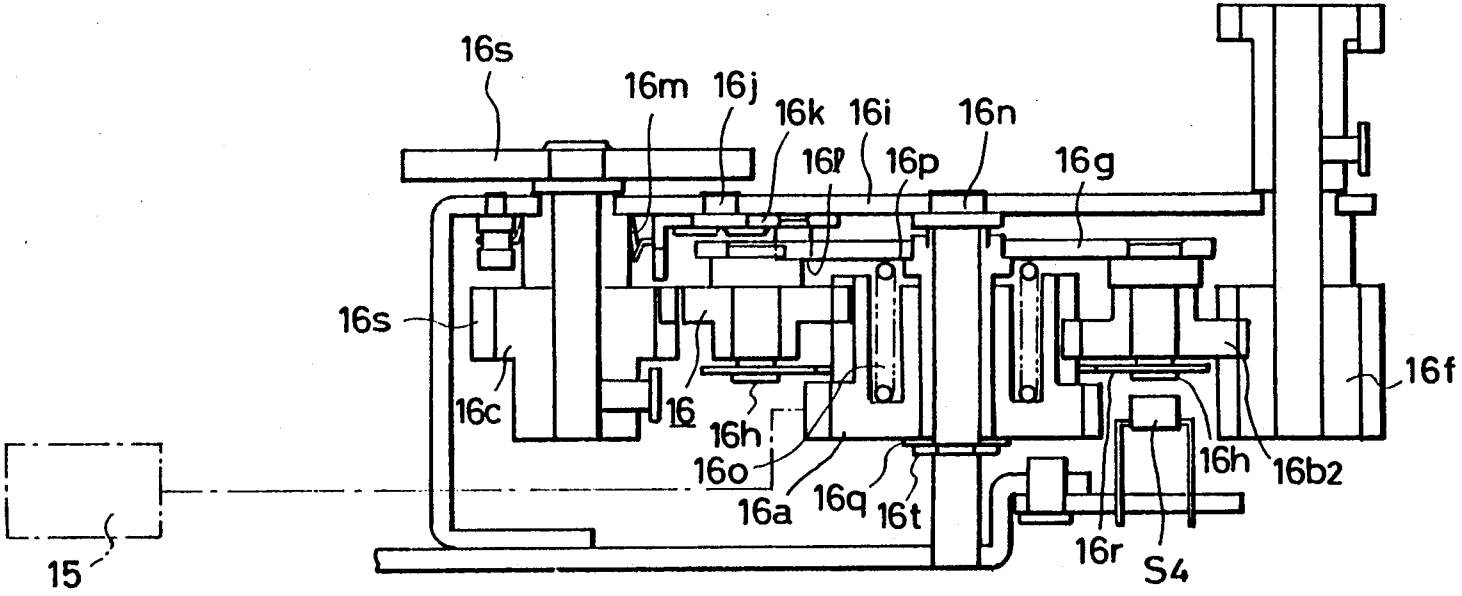

The following explanation relates to the clutch 16, as illustrated in FIGS. 20 and 21, which switches and transmits a driving force to the supply-discharge belt 3*c*, platen 4, and/or wind reel 6*e* of ink sheet 7. FIG. 20 shows a plane view of the clutch 16 and FIG. 21 is a section taken from line A—A in FIG. 20. The clutch 16 has a sun gear 16*a* which rotates in the forward direction of arrow n or in the reverse direction dependent upon the direction it is driven by the St motor 15. The clutch also has planetary gears 16b1, 16b2 and 16b3 which engage with the sun gear 16*a*. Further, the planetary gears 16b1, 16b2 and 16b3 engage with 1) a platen gear 16*c* for transmitting a driving force to the platen 4, 2) a supply-discharge gear 16*d* for transmitting a driving force to the supply-discharge belt 3*c*, 3) a platen lock gear 16*e* for locking rotation of the platen 4 and 4) a winding gear 16*f* for transmitting a driving force to the winding reel 6*e* of the ink cassette 6. The platen lock gear 16*e* is connected through a gear train or belt with the platen 4 or platen gear 16*c*.

The planetary gears 16b1, 16b2 and 16b3 are arranged around the sun gear 16*a* at angles of 45 degrees and these gears are rotatively fixed to planet gear axes 16*h* attached to a rotary engaging disk 16*g* as shown in FIG. 20 and FIG. 21. Further, the platen gear 16*c*, supply-discharge gear 16*d*, platen lock gear 16*e* and winding gear 16*f* are sequentially arranged around the rotary engaging disk 16*g* at angles of 90 degrees.

Around an outer circumference of the rotary engaging disk 16*g*, hook-shaped engaging parts 16g1 are formed at equal intervals along the circumference, and these engaging parts 16g1 engage with an engaging projection 161 attached at one end of an L-shaped plate 16*k* that rotates around an axis 16*j* attached to a clutch chassis 16*i*. The other end of the L-shaped plate 16*k* is pulled by a tug spring 16*m* in a direction to engage the projection 161 with the engaging part 16g1. The sun gear 16*a* and rotary engaging disk 16*g* are rotatively mounted upon a sun gear axis 16*n* and fixed to the clutch chassis 16*i*. A pressure spring 16*o* is attached through a friction washer 16*p* and disposed between the sun gear 16*a* and rotary engaging disk 16*g* as shown in FIG. 21. Attached to the sun gear 16*a* are a stop ring 16*t* and washer 16*q* attached as shown in FIG. 21 so that the gear 16*a* does not move downward in the direction of its axis and the rotary engaging disk 16*g* cannot move in the direction of the axis. Accordingly, when the St Motor 15 rotates, the sun gear 16*a* rotates and rotary power is transmitted to the rotary engaging disk 16*g* by the friction force of the pressure spring 16*o* through the friction washer 16*p* such that the rotary torque transmitted to the rotary engaging disk 16*g* is limited. Accordingly, when the sun gear 16*a* rotates in the direction of arrow n in FIG. 20, engaging parts 16g1 of the rotary engaging disk 16*g* gear engage with the engaging projection 16*l* and its rotation is stopped. Thus, the rotary engaging disk 16*g* stops its rotation and the planetary gears 16b1, 16b2 and 16b3 rotate through their engagement with the sun gear 16*a*. On the other hand, when the sun gear 16*a* rotates in the reverse direction, the engaging parts 16gi do not act to stop the rotation and the rotary engaging disk 16*g* continues to rotate along with the sun gear 16*a*. The rotary engaging disk 16*g*, L-shaped plate 16*k* with the engaging projection 16*l* and tug spring 16*m* work to form a ratchet mechanism. During this time, the planetary gears 16b1, 16b2 and 16b3 rotate around the sun gear 16*a* and do not transmit a rotary force.

A sensor plate 16*r* is attached to a tip of the planetary axis 16*h* which is attached to the rotary engaging disk 16*g*. On the surface of the sensor plate 16*r*, marks 16r1 are affixed which are arranged at eight equal intervals as shown in FIG. 3. Further, a clutch sensor $S_4$ is placed opposite to the sensor plate 16*r* as shown in FIG. 21. Accordingly, by detecting marks 16r1 of the rotary sensor plate 16*r* with the clutch sensor $S_4$, the rotary position of the rotary engaging disk 16*g* which rotates with the sensor plate 16*r* as one body can be detected.

The following explanations relate to the switching and transmitting of the driving force of the St motor 15 to the supply-discharge belt 3*c*, platen 4, etc. by the above-described clutch 16.

In FIG. 20, the planetary gear 16b1, engages with the platen gear 16*c*, the planetary gear 16b3 with the winding gear 16*f* and the planetary gear 16b2 does not engage with a line of gears. Accordingly, when the St motor 15 is rotated in the forward direction, the sun gear 16*a* rotates in the direction of arrow n. But, the rotary engaging disk 16*g* does not rotate because of engaging projection 16*e*, so the rotary force of the sun gear 16*a* is transmitted through planetary gears 16b1 and 16b3 to the platen gear 16*c* and winding gear 16*f*, which engage with gear mechanism 16*s* (FIG. 21) transmits a rotary force to the platen 4 and wind reel 6*e*.

Further, when the St motor 15 is rotated from the situation of FIG. 20 in the reverse direction and the rotary engaging disk 16*g* rotates 45 degrees in the direction opposite to arrow n, the planetary gear 16b2 engages with the platen gear 16*c* and the engaging state of other planetary gears 16b1 and 16b3 is released. Accordingly, when the St motor 15 is rotated in the forward direction, through the planetary gear 16b2 rotary force is transmitted only to the platen 4. Namely, by driving the St motor in the reverse direction and rotating the rotary engaging disk 16*g* 45 degrees each time as discussed above, the engaging state of planetary gears 16b1, 16b2 and 16b3 with the platen gear 16*c*, supply-discharge gear 16*d*, winding gear 16*e* and platen lock gear 16*f* can be switched. Moreover, by driving the St motor 15 in the forward direction, a rotary force can be transmitted to each gear which engages with the planetary gears 16b1, 16b2 and 16b3. Additionally, according to the present embodiment, the position of the rotary engaging disk 16*g* is detected by the clutch sensor $S_4$ each time it rotates 45 degrees and at each step, depending on its clutch position (hereinafter referred to as "CP"), a driving force is transmitted to one or more elements such as the platen 4 as shown in Table 2.

TABLE 2

| C P | gears that engage with planet gears |
|---|---|
| 0 | platen gear |
| 1 | supply-disharge gear, platen gear |

TABLE 2-continued

| C P | gears that engage with planet gears |
|---|---|
| 2 | supply-discharge gear |
| 3 | platen-lock gear, supply-discharge gear |
| 4 | platen-lock gear |
| 5 | winding gear, platen-lock gear |
| 6 | winding gear |
| 7 | platen gear, winding gear |

Thus, by using the clutch 16 and by driving the St motor 15 in the reverse direction, the engaging state of planetary gears 16b1, 16b2 and 16b3 with the platen gear 16c, supply-discharge gear 16d, etc. is switched, and by driving the St motor 15 in the forward direction a driving force can be selectively transmitted to the selected elements. Accordingly, selective drive of the platen 4, supply-discharge belt 3c or winding reel 6e can be carried out by one motor. Because it is not necessary to provide motors for each element individually, the number of motors and their costs can be reduced and, moreover, the space needed for the apparatus is significantly reduced.

Figure 22:
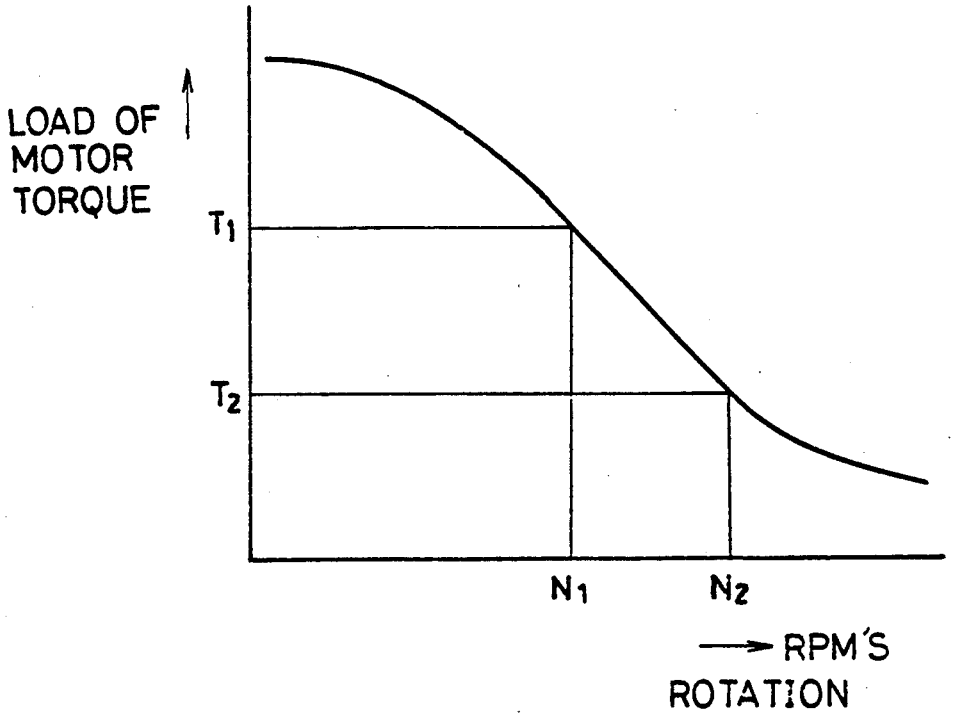
FIG. 22 is a graph showing the relationship between rotational frequency and torque of the motor.

The load imposed on the St motor is different when in its reverse rotation (when the clutch is switched) than when in its forward rotation (at the time of driving the platen 4, etc.). The load is smaller when in the reverse rotation and larger during the forward rotation. The St motor 15 has RPM and torque characteristics as shown in FIG. 22 such that rotary torque is large when the speed of revolution of St motor 15 is low, and the rotary torque is small when the speed of revolution is high. Therefore, by utilizing these characteristics, the RPM's of the St motor is varied so that during a forward rotation, when a big load is imposed, a large torque $T_1$ is generated by making the RPM's small ($N_1$), and during a reverse rotation when a load is small the speed switched by the clutch increases, by increasing the RPM's ($N_2$) (at this time torque is $T_2$).

By varying the RPM's of the St motor 15 according to the changing load, it is not necessary to provide motors separately for each load and the driving force of one St. motor 15 can be selectively transmitted to the platen 4, the supply-discharge belt 3c, or the winding reel 6e.

Figure 23:
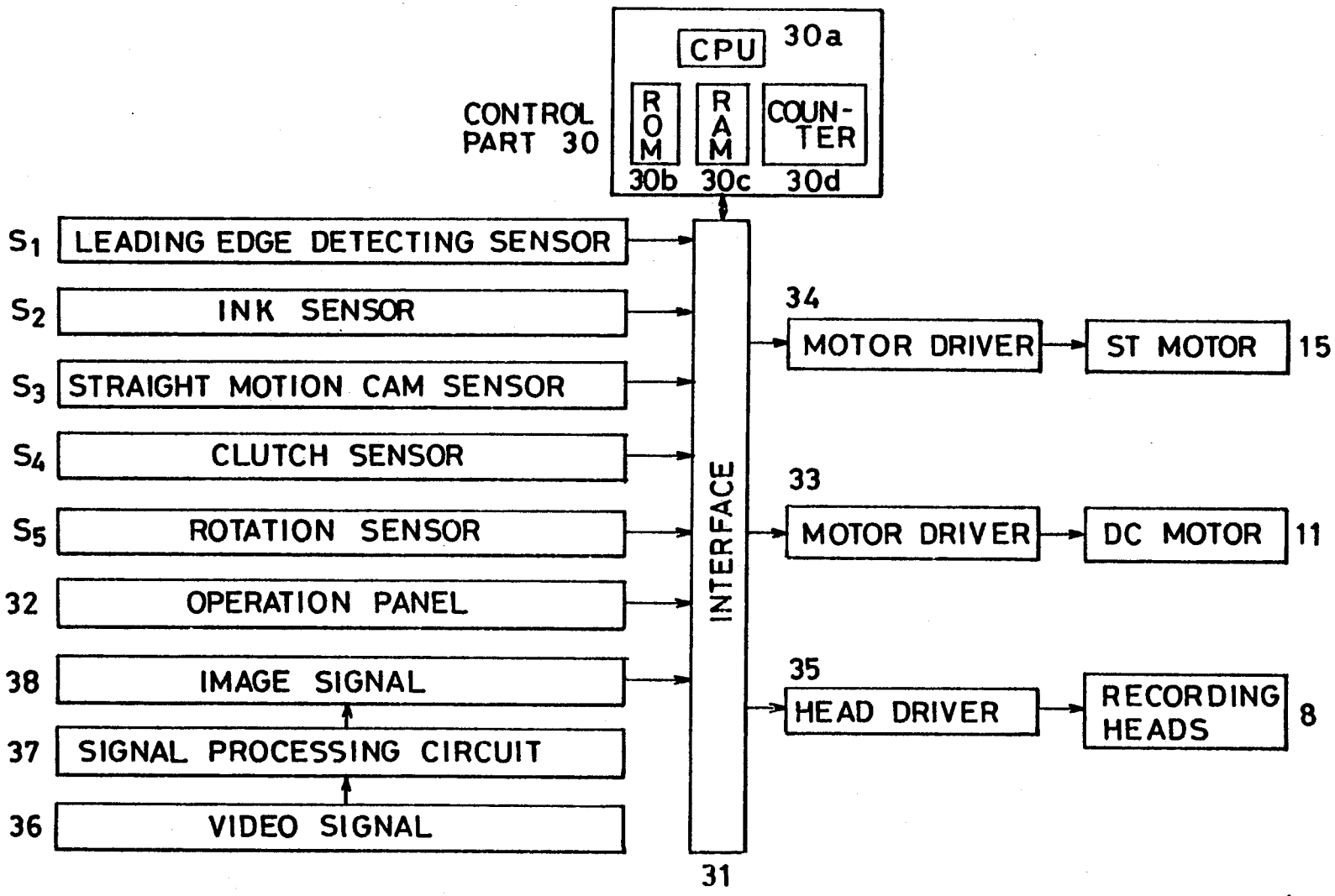
FIG. 23 is a block diagram of the control system.
Figure 24A:
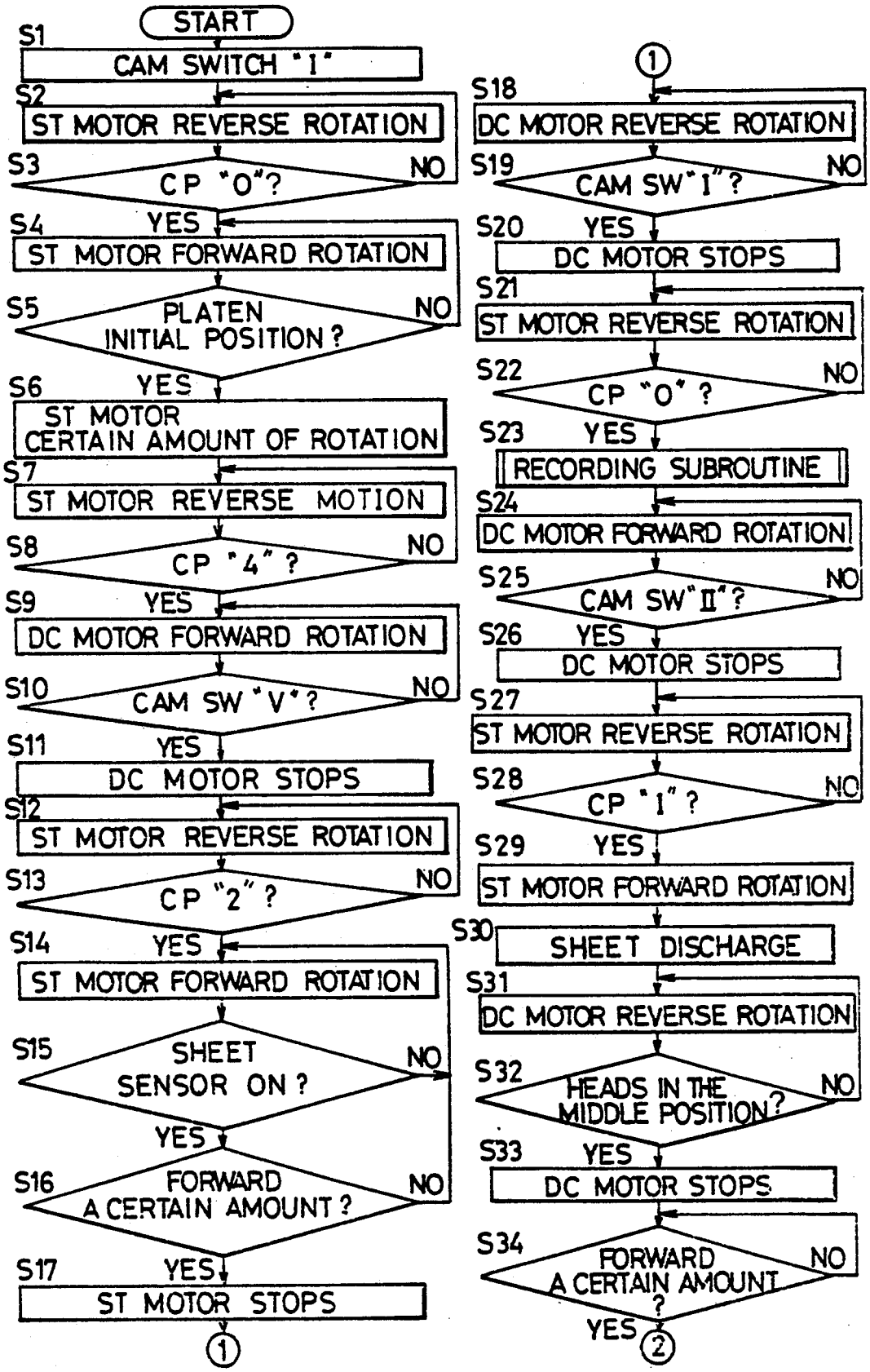
FIGS. 24(A) and (B) and FIG. 25 are flow charts illustrating the operation of the reading apparatus.
Figure 24B:
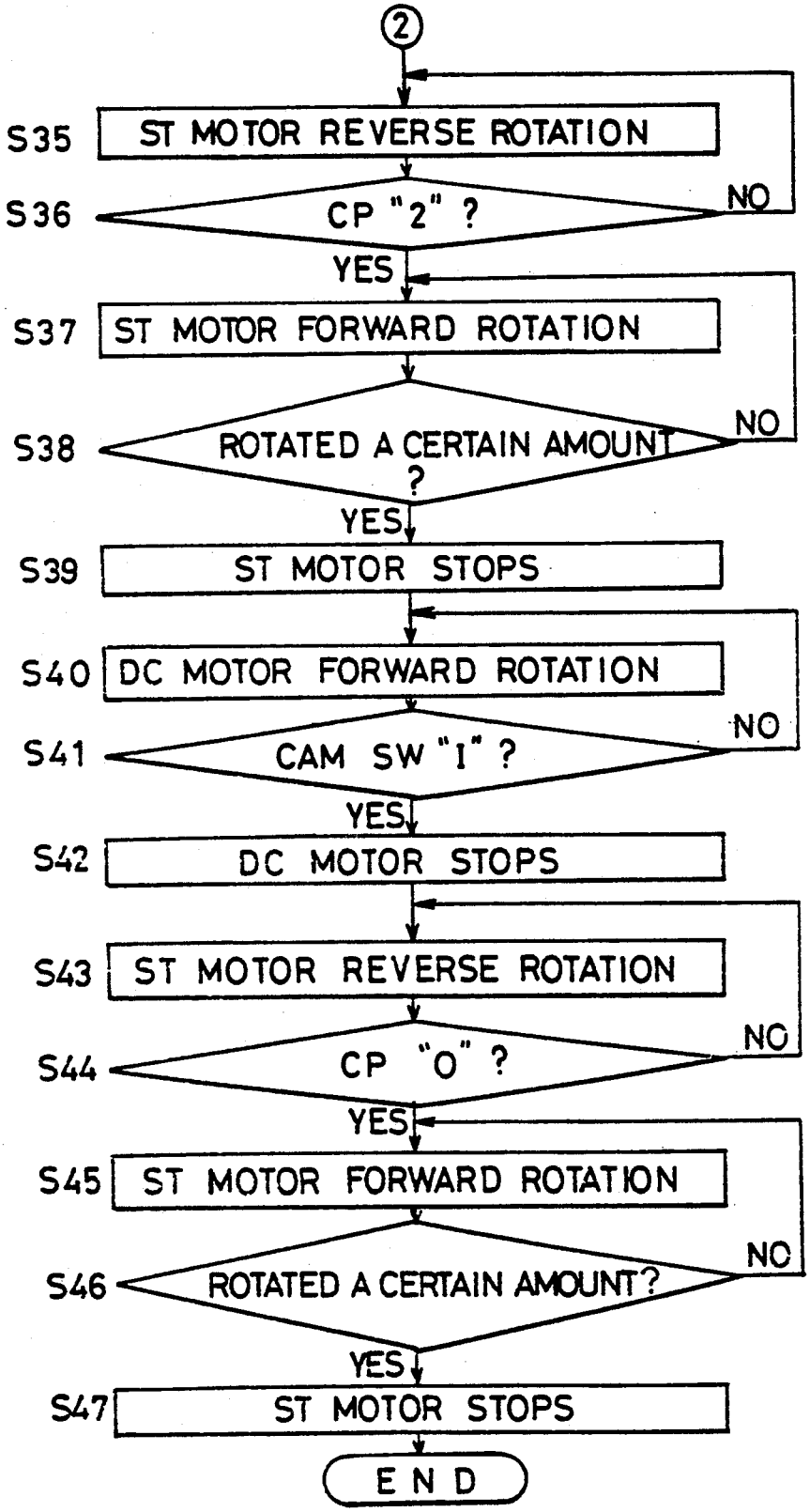
Figure 25:
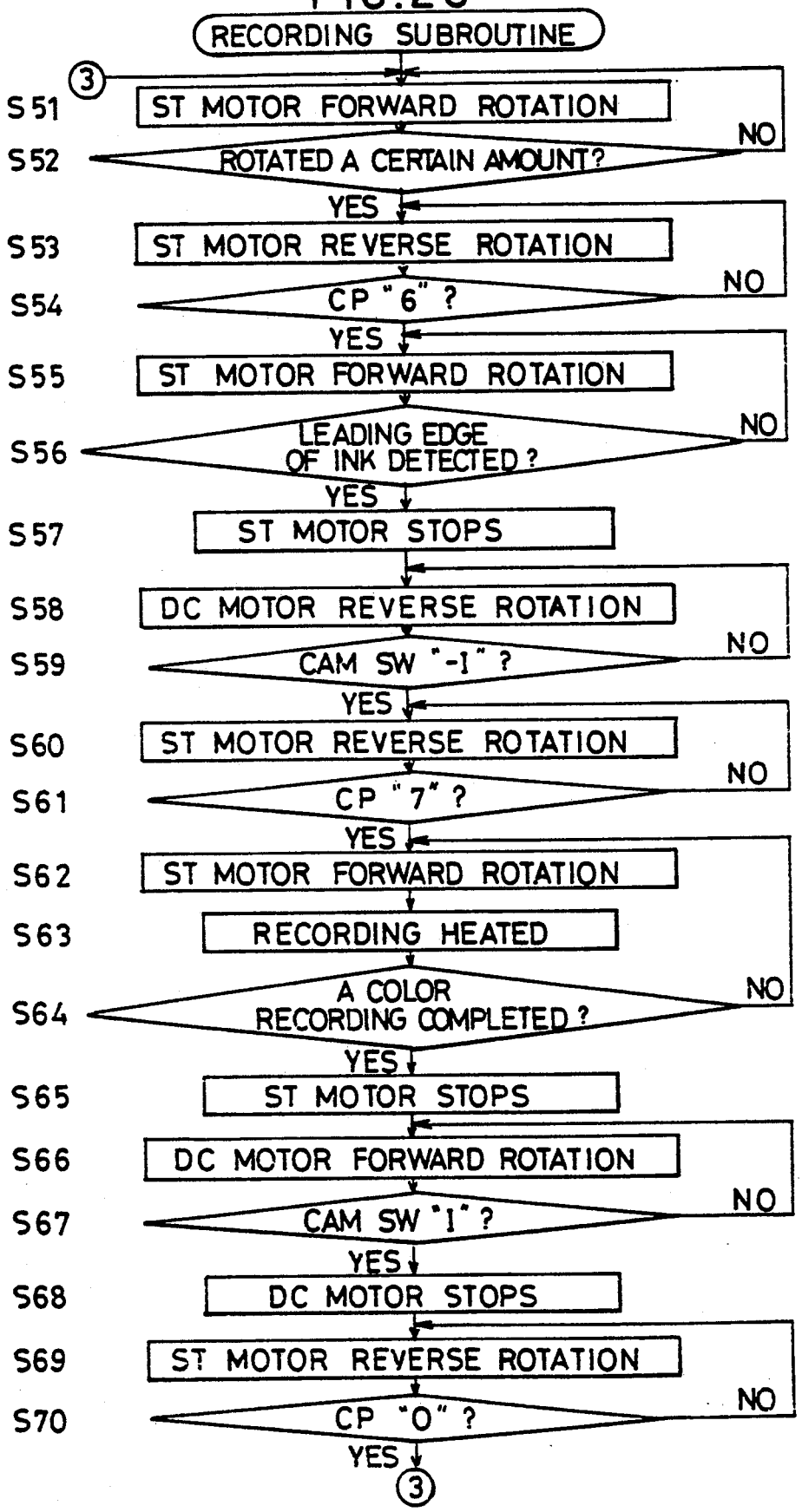

The following is an explanation of control system for driving each element as illustrated in FIGS. 23 through 25. The control system comprises CPU 30a such as a microprocessor, a ROM 30b for storing control programs for the CPU 30a or various data, and a RAM 30c which is used as a work area for the CPU 30a. A control part 30 includes a counter 30d for counting RPM's and is connected to an interface 31, an operation panel 32, a motor driver 33 for a DC motor 11, a motor driver 34 for the St motor 15, a head driver 35 for heat-driving the recording heads 8, and the sensors $S_1$–$S_5$.

Various information from the operation panel 32 and signals from sensors $S_1$–$S_5$ are input through the interface 31 into the control part 30, which further receives an input image signal 38 for driving the recording heads 8 to which an input video signal 36 is converted by a signal processing circuit 37. The control part 30 outputs an image signal and signals for ON and OFF, as well as forward and reverse rotation of the motor through the interface 31 to drive the DC motor and St motor.

In the recording apparatus according to the present embodiment, the operation panel 32 is provided with a platen release switch which releases a connection between the platen 4 and clutch 16 and frees the platen 4. This means that when platen release switch (not shown) is turned on, CP of the clutch 16 is switched, for example, to "2" or "6" and planetary gears 16b1, 16b2, 16b3 are not in engagement with the platen gear 16c. Accordingly, in case jamming or the like occurs during recording, if the platen release switch is turned on, the platen 4 can rotate freely so that an operator can manually take care of the jamming or a similar problem. Further, besides the platen release switch, a jam sensor (not shown) can be provided near the platen 4 and if jamming occurs, a signal from the jam sensor can automatically switch the CP.

The following is an explanation of the operation steps when recording is carried out with the recording apparatus described above, with reference to flow charts of FIGS. 24(A) and (B) and 25.

At first, when a record starting signal is input at step S1 in FIG. 24, the switch for straight motion cams 13 and 14 is positioned at "I" as shown above in Table 1. At steps S2 and S3, the St motor 15 is driven in the reverse direction and a CP is detected by the clutch sensor $S_4$ to position it at "0" as shown in Table 2, namely, to drive only the platen 4.

After drive of the St motor 15 is stopped, at steps S4 and S5 the St motor 15 is driven in the forward direction to rotate the platen 4 together with the gripper 5 to its initial position. Further, at step S6 the St motor is rotated a certain amount in the forward direction and the platen 4 is rotated until the gripper 5 comes to the position shown in FIG. 14. Then at steps S7 and S8, the St motor 15 is driven in the reverse direction, the CP of the clutch 16 is switched to "4" and by connecting the St motor 15 with the platen lock gear 16e and idling the St motor 15, the platen 4 is locked.

Figure 17A:
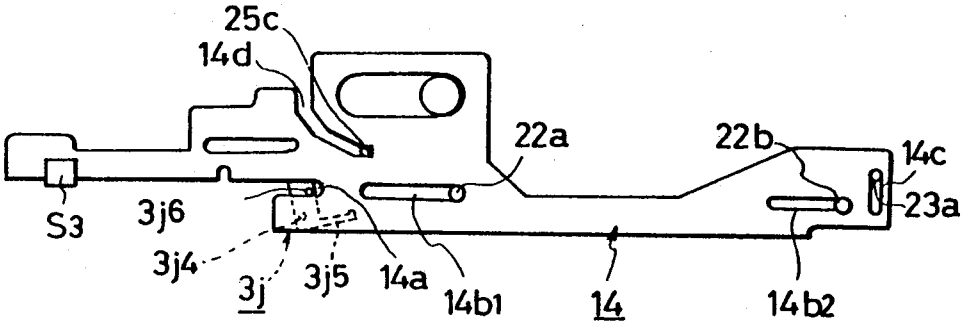
FIGS. 17(A) and 17(B) are sectional views of the apparatus during still another switching stage.
Figure 17B:
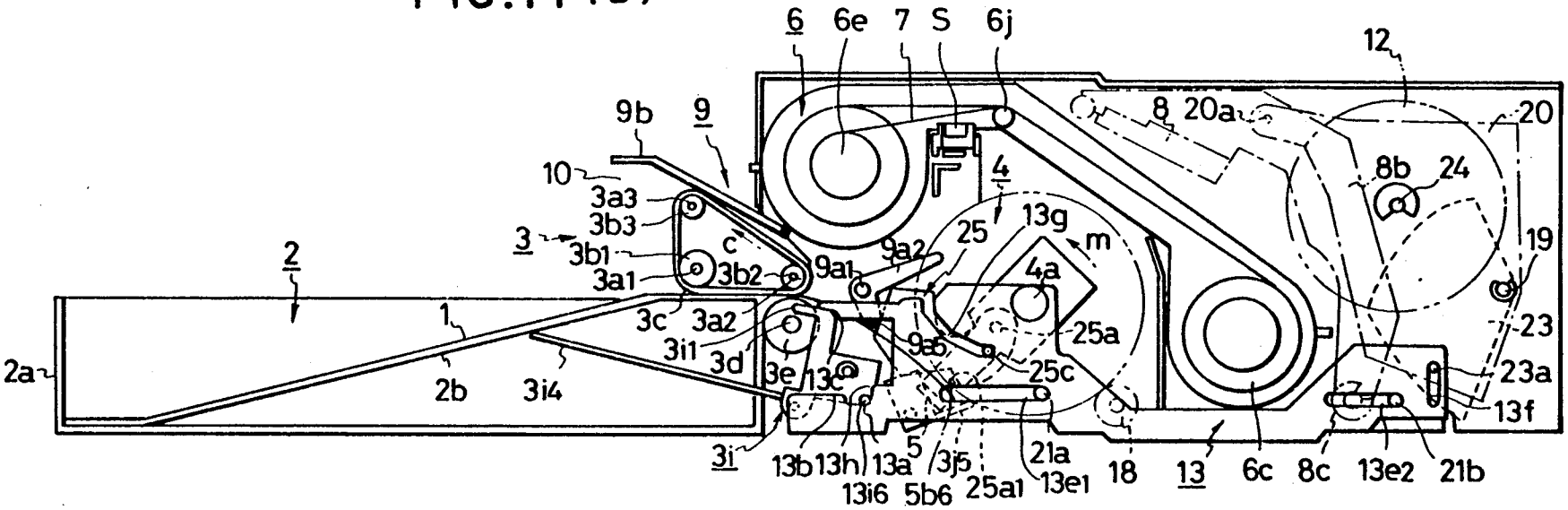

Next, at Steps S9–S11, the DC motor is driven in the forward direction to slide the straight motion cams 13 and 14 position so that the cam switch is in position "V" as detected by the straight motion cam sensor $S_3$. Thereby, the supply board 3i goes up, as shown in FIG. 17, the separation roller 3c presses the recording sheet 1 within the cassette 1 to the supply-discharge belt 3c, the register element 3j goes up, and the pressure contact element 3j5 comes in contact with the surface of the platen 4. Further, the first engaging part 25b1 of the gripper cam 25 pushes up the cam projection 5b6 to put the gripper 5 in an open state.

At steps S12 and S13, the St motor is driven in the reverse direction to switch the CP to "2" and transmit driving force only to the supply-discharge belt 3c. At step S14, when the St motor 15 is driven in the forward direction, the supply-discharge belt 3c rotates in the direction of arrow c in FIG. 17 and the recording sheet 1 is separated and sent forth one by one. When the sheet is sent forth at steps S15–S17, the sensor $S_1$ for detecting the leading edge of the sheet detects the edge and upon forwarding a certain length of the sheet, the St motor stops. Thereby, the leading edge of the recording sheet 1 is brought in contact against the register element 3j to register the position of the leading edge and to correct any misalignment.

At steps S18–S20, the DC motor is driven in the reverse direction to return the straight motion cams 13 and 14 so that the cam switch position is "I". At that position, the gripper 5 holds the leading edge of the recording sheet 1 against the platen 4, the supply board 3i together with the register 3j goes down to push up the discharge lever 9a. At steps S21 and S22, the St motor 15 is driven in the reverse direction to switch the CP of the clutch 16 to "0" and at step 23 recording is carried out.

In order to record colors of yellow, magenta and cyan, a recording subroutine is composed as shown in FIG. 25. At steps S51 and S52, the St motor is driven in the forward direction to rotate the platen 4 a certain amount, forward the leading edge of the recording sheet to a certain position and fix its starting position for recording.

At steps S53 and S54, the St motor is driven in the reverse direction to switch the CP of clutch 16 to "6". After the winding gear 16*e* engages with the planetary gear, at steps S55–S57, the St motor 15 is driven in the forward direction to wind up the ink sheet 7 onto the wind reel 6*e* until the ink sensor S2 detects the head mark 7*a* of yellow Y on the ink sheet 7, so that a starting position of the ink sheet 7 is fixed.

At steps S58 and S59, the DC motor 11 is driven in the reverse direction to rotate the rotary cam 12 to the switch "−I" position, with the rotary sensor $S_5$ and to bring down the recording heads 8.

At steps S60–S65, the St motor is driven in the reverse direction to switch the CP of the clutch 16 to "7" and engage the platen gear 16*c* and winding gear 16*e* with the planetary gears. Then, the St motor is driven in the forward direction to rotate the platen 4 and wind reel 6*e* in the directions of arrows a and g of FIG. 2, respectively, to forward the recording sheet 1 and ink sheet 7 under pressure contact, and heat elements of the recording heads 8 according to image signals for initially recording yellow.

When the yellow recording is finished, at steps S66–S68, the DC motor is driven in the forward direction to rotate the rotary cam to switch "I" and to raise the recording heads 8. Next, at steps S69 and S70, the St motor is driven in the reverse direction to switch the CP of the clutch 16 to "0" and engage the platen gear 16*c* with the planet gear. Then, the operation returns to the step S51 and magenta and cyan recordings are carried out in the same manner as the yellow recording. By the above-mentioned subroutine, colors of yellow, magenta and cyan are recorded on the recording sheet 1.

After color recordings are finished, the operation is transferred to steps S24–S26 and the DC motor 11 is driven in the forward direction to slide straight motion cams 13 and 14 to a position of switch "II", and the discharge lever 9*a* goes down.

At steps S27 and S28, the St motor is driven in the reverse direction to switch the clutch 16 to CP "1". Then, at steps S29 and S30, the St motor is driven in the regular direction to rotate the platen 4 and supply-discharge belt 3*c*. When the gripper 5 of the platen 4 rotates to a certain position, the cam projection 5b6 engages the second engaging part 25b2 of the gripper cam 25, and the gripper 5 releases its hold on the recording sheet 1. The platen 4 rotates further until the engaging projection 5b4 of the gripper 5 rests in the round groove 4*b* of the platen 4 to maintain the release of the sheet, as shown in FIG. 7(B). Accordingly, after this, only the platen 4 rotates while the gripper 5 remains in the release position.

Figure 18:
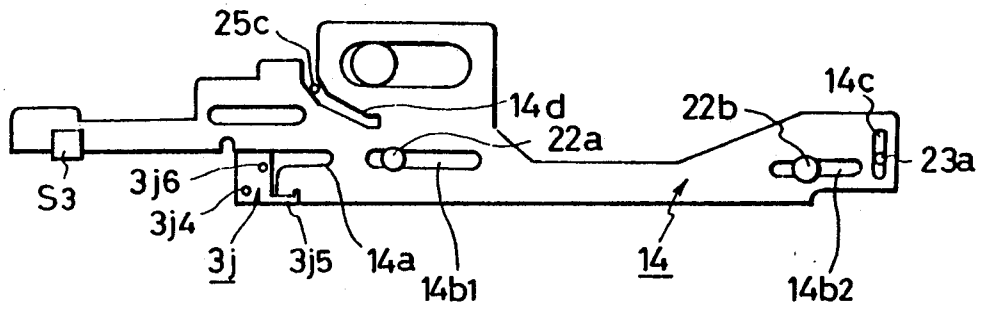
FIGS. 18(A) and 18(B) are sectional views of the apparatus during another switching stage.
Figure 18:
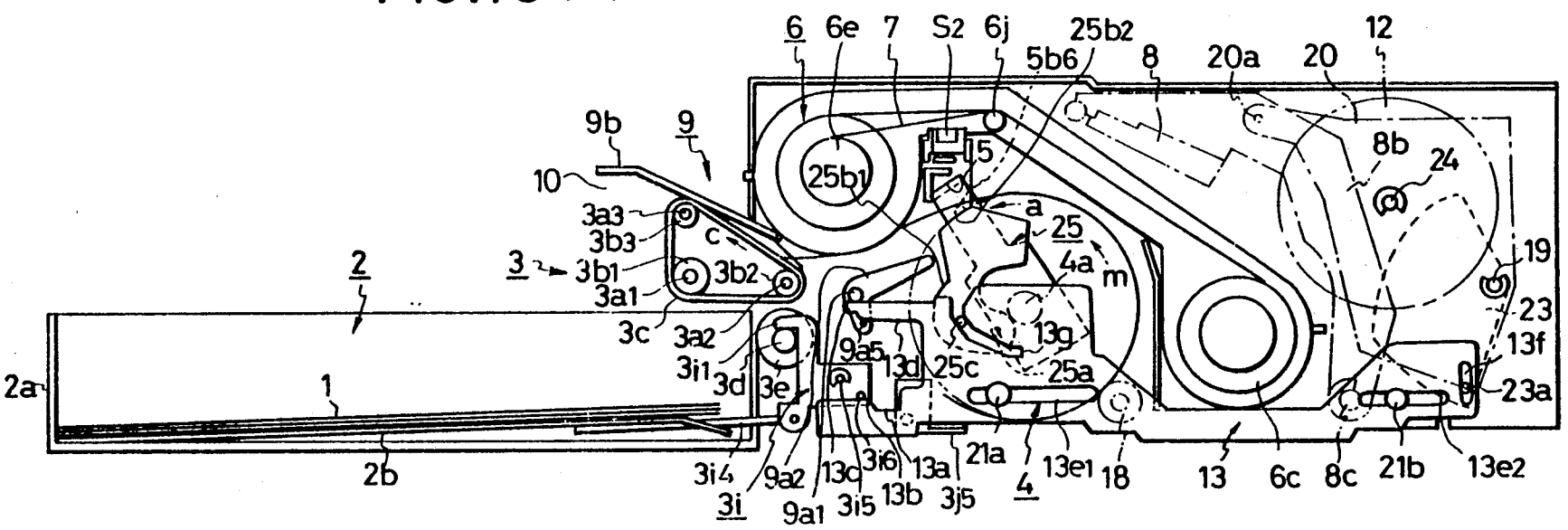

The recording sheet 1, with the leading edge being released from the gripper 5, is discharged and forwarded by the platen 4 and pinch roller 18 and at that time, the leading edge of the recording sheet 1 is guided by the lower surface of the ink cassette 6 as shown in FIG. 18 and is led to the discharge outlet 10 by the discharge lever 9*a*.

According to the present embodiment, in discharging the recording sheet 1, the ink cassette 6 functions as a sheet guide, and therefore it is not necessary to provide an element for guiding the upper face of the recording sheet 1 near the platen 4. As a result, the number of apparatus parts can be decreased, the size of the apparatus is reduced and less space is needed for the apparatus.

Figure 19:
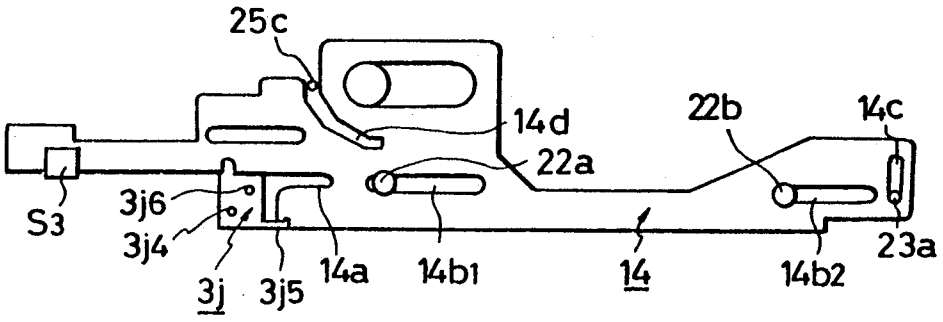
FIGS. 19(A) and 19(B) are sectional views of the apparatus during still another switching stage.
Figure 19:
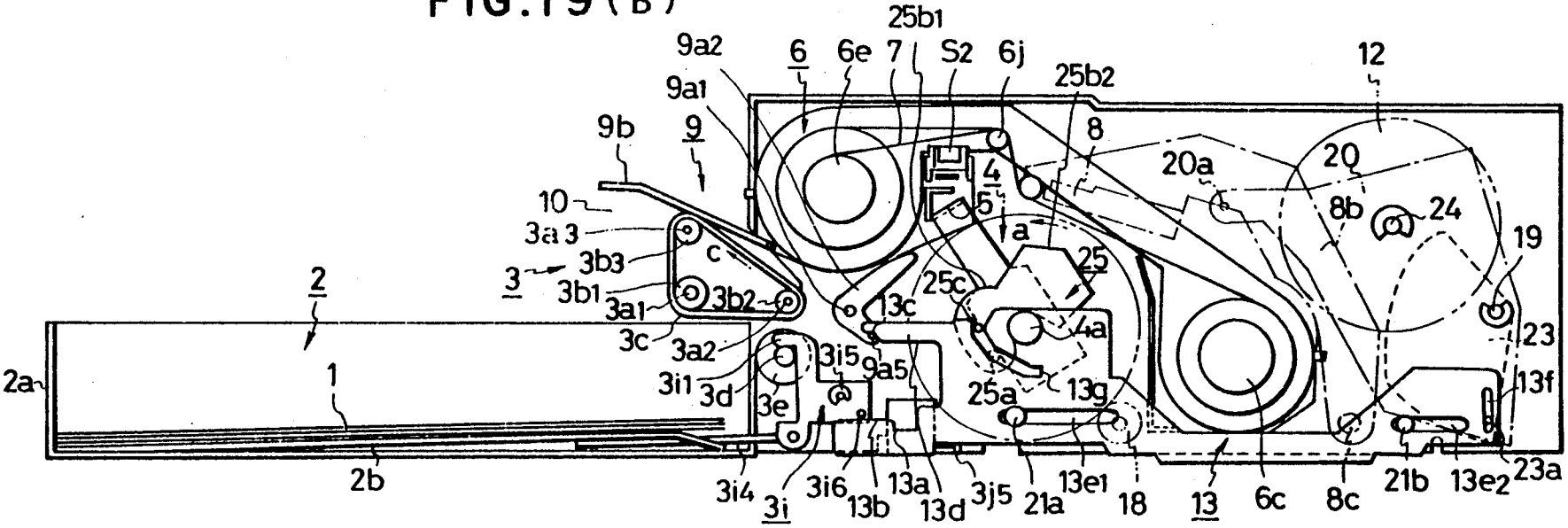

Further, when the sheet is discharged, its leading edge is guided to the discharge side by the discharge lever 9*a*. After that, at steps S31–S33, the DC motor is rotated a certain amount (by controlling its time of motion) to rotate the rotary cam 12 a certain amount and lower the recording heads 8 to the middle position between its up and down state, as shown in FIG. 19. When the platen rotates in the above state, the recording sheet 1, with its leading edge released by the gripper 5, is held down by the recording heads 8, and thus, it can be discharged without sagging. In this way, the recording heads 8 and ink cassette 6 function as a guide element of the recording sheet 1 so that the recording sheet 1 is discharged without needing special guide elements around the platen 4.

Further, at step S34, the recording sheet 1 is forwarded a certain amount by the St motor and after the leading edge of the recording sheet 1 is caught by the supply-discharge belt 3C, the St motor 15 is driven in the reverse direction at steps S35 and S36 to switch the CP of the clutch 16 to "2". Then at steps S37–S39, the St motor 15 is driven in the forward direction to rotate only the supply-discharge belt 3*c* so that the recording sheet 1 is discharged by the belt 3*c* and guide element 9*b*, which is brought into contact with the belt 3*c* by its own weight.

After the recording sheet 1 is discharged at steps S40–S42, the DC motor 11 is driven in the regular direction to slide straight motion cams 13 and 14 to the position of switch "I". At steps S43 and S44, the St motor 15 is driven in the reverse direction to switch the CP of clutch 16 to "0". Consequently, at steps S45–S47, the St motor 15 is driven in the forward direction. When the platen 4 rotates to a certain position, the engaging projection 5b4 falls into the stopping groove 4b1 of the platen 4 due to the tug spring 5*c* of the gripper 5 as shown in FIG. 7(A) and the gripper 5 and the platen 4 rotate together. If jamming happens during the recording operation, the platen release switch as discussed above is activated to free the platen 4.

As explained above, according to the present embodiment, color recording can be carried out according to image signals from video devices, etc. by a small-sized apparatus. Additionally, as an example of image signals, a video signal has been selected for purposes of explanation. However, as a matter of course, signals read from documents, output signals from computers or the like can be used as image signals.

According to the present invention, by utilizing the characteristic of the electric motor, that is by slowing down the speed (RPM's) in case of heavy loading and raising the speed (RPM's) in case of light loading, a proper rotary force can be transmitted to correspond to the changing loads on the motor. Accordingly, if a clutch is driven as discussed above, both switching of the clutch and driving of drive systems can be carried out by one motor, which decreases the number of motors and cost of the apparatus, as well as reduces the size of the apparatus.

While the present invention has been described with respect to what is presently considered to be preferred embodiments, it is to be understood that the invention is not limited to the disclosed embodiments. To the contrary, the present invention includes all modifications and arrangements within the scope of the appended claims.

What is claimed is:

1. A sheet supplying apparatus, comprising:

sheet supply means for supplying a sheet from a stack of sheets;

transport means for transporting a sheet supplied by said sheet supply means;

a first rotary driven member for driving said sheet supply means;

a second rotary driven member for driving said sheet transport means;

rotary drive means for driving either one of said first and second rotary driven members; and support means for supporting said rotary drive means to be displaceable between a first position where said first rotary driven member can be driven, a second position where said second rotary driven member can be driven or a third position where said first rotary driven member and said second rotary driven member can be driven at the same time.

2. A sheet supplying apparatus according to claim 1, further comprising;

displacement means for displacing said rotary drive means; and control means for controlling said displacement means which displaces said rotary drive means to the first position so the sheet can be transported by said sheet supplying means and displaces said rotary drive means to the second position so the sheet transported by said sheet supplying means can be transported by said transport means.

3. An apparatus according to claim 1, wherein said rotary drive means includes a sun gear and planetary gears which revolve around said sun gear and are engageable therewith.

4. An apparatus according to claim 3, wherein said support means prohibits said planetary gears from revolving around said sun gear when said sun gear rotates in a forward direction and permits said planetary gears to revolve around said sun gear when said sun gear rotates in a reverse direction.

5. An apparatus according to claim 3, wherein each of said first and second rotary driven members includes a gear which can engage with one of said planetary gears when said rotary drive means is in either of the first and second positions and does not engage with one of said planetary gears when said rotary drive means is in another position.

6. An apparatus according to claim 5, further comprising ratchet means for prohibiting said planetary gears from revolving around said sun gear when said sun gear rotates in a forward direction and permitting said planetary gears to revolve around said sun gear when said sun gear rotates in a reverse direction.

7. An apparatus according to claim 6, wherein said support means rotatably supports said planetary gears and permits them to revolve around said sun gear.

8. An apparatus according to claim 7, further comprising transmission means cooperating with said sun gear for transmitting the driving force of said sun gear to said support means so said planetary gears can revolve around said sun gear.

9. An apparatus according to claim 8, wherein said transmission means limits the amount of driving force transmitted from said sun gear to said supporting means.

10. An apparatus according to claim 4, further comprising a stepping motor for rotating said sun gear, and wherein said sun gear is rotated in the reverse direction at a higher speed than in the forward direction by said stepping motor.

11. An apparatus according to claim 1, further comprising recording means for recording on a sheet transported by said transport means.

* * * * *